United States Patent [19]

Okumura et al.

[11] Patent Number: 5,070,342

[45] Date of Patent: Dec. 3, 1991

[54] THERMAL PRINTER

[75] Inventors: Takashi Okumura, Nagoya; Koshiro Yamaguchi, Inuyama; Michio Ueda, Gamagoori, all of Japan

[73] Assignee: Brother Kogyo Kabushiki Kaisha, Japan

[21] Appl. No.: 475,017

[22] Filed: Feb. 5, 1990

[30] Foreign Application Priority Data

Feb. 7, 1989 [JP] Japan ..... 1-28050
Feb. 7, 1989 [JP] Japan ..... 1-28051

[51] Int. Cl.[5] ..... B41J 2/325
[52] U.S. Cl. ..... 346/76 PH; 400/120
[58] Field of Search ..... 346/76 PH; 400/120

[56] References Cited

U.S. PATENT DOCUMENTS 4,865,901 9/1989 Ohno et al. .
4,890,120 12/1989 Sasaki et al. ..... 346/76 PH
4,897,670 1/1990 Hasegawa et al. ..... 346/76 PH
4,913,567 4/1990 Imamaki et al. ..... 346/76 PH

FOREIGN PATENT DOCUMENTS 62-30074 2/1987 Japan .

*Primary Examiner*—Benjamin R. Fuller
*Assistant Examiner*—Huan Tran
*Attorney, Agent, or Firm*—Kane, Dalsimer, Sullivan, Kurucz, Levy, Eisele and Richard

[57] ABSTRACT

A thermal printer is provided which may use various types of ribbons including print only and print and erase ribbons. The printer includes a memory having stored therein predetermined printing condition data corresponding to a plurality of print modes including a mode in which only printing may be executed and a mode in which both printing and erasing may be executed. One of the modes is selected based upon the type of ink ribbon being used and the printing conditions are set in accordance with the stored data for the selected ribbon.

18 Claims, 18 Drawing Sheets

THERMAL PRINTER

BACKGROUND OF THE INVENTION

The present invention relates to a thermal printer, and more specifically, to a thermal printer in which the printing conditions can be changed in accordance with a kind of a ink ribbon used.

In general, a thermal printer is equipped with a thermal head provided with a plurality of heating elements arranged in a vertical single column, and printing is carried out in such a manner that a carriage mounted on the thermal head is moved with respect to a recording sheet in a direction perpendicular to the direction in which the heating elements are arranged while the thermal head is pressed against the recording sheet and at the same time, a pulse voltage is applied to all of the heating elements or selectively applied to a part thereof to print characters and the like in a dot pattern on a thermosensitive recording sheet or a usual recording sheet through a ink ribbon.

Conventionally, one-time ink ribbons are widely used, but correctable ink ribbons have been produced to enable incorrectly typed characters to be instantly corrected when printing is carried out while characters are input through a keyboard of an electronic typewriter provided with a thermal printer, and more recently, multi-time ink ribbons have been produced to permit ink ribbons to be used several times, to enable a reduction in the cost of using ink ribbons.

As shown in FIG. 1, a one-time ink ribbon 49 has a four-layer structure composed of a top coat layer 49*a* having a high melting viscosity and relatively poor adhesion to a recording sheet, an ink layer 49*b* on which resin type transfer ink is coated, a base film 49*c* such as polyester or the like, and a sticking prevention layer 49*d* composed of a heat resistant resin.

As shown in FIG. 2, a correctable ink ribbon 50 (refer to Japanese Provisional Patent Publication Sho 62-108090) has a five-layer structure composed of a top coat layer 50*a*, an ink layer 50*b* on which resin type transfer ink is coated, an exfoliation layer 50*c* composed of wax and having a poor adhesion with a base film 50*d*, the base film 50*d*, and a sticking prevention layer 50*e*.

As shown in FIGS. 3 (*a*), (*b*), and (*c*), when printing is carried out, the correctable ink ribbon 50 is pressed against a recording sheet 58 by a thermal head, and a voltage is applied to heating elements 22. The correctable ink ribbon 50 is heated through the sticking prevention layer 50*e*, and thus, as shown in FIG. 3 (*a*), the exfoliation layer 50*c* is melted so that the top coat layer 50*a* is adhered to the recording sheet 58 as a transfer ink 80 together with the ink layer 50*b*, by the adhesive force of the top coat layer 50*a*.

On the other hand, as shown in FIG. 3 (*b*), when an incorrectly printed character must be deleted, the correctable ink ribbon 50 is overlapped on and pressed against the character and the heating elements 22 are heated by the application of a pulse voltage. In this case, the exfoliation layer 50*c*, the ink layer 50*b*, the top coat layer 50*a*, and the transfer ink 80 are melted, respectively, through the sticking prevention layer 50*e* and the base film 50*d*, and then the exfoliation layer 50*c*, the ink layer 50*b*, the top coat layer 50*a*, and the transfer ink 80 are cooled, respectively, in a predetermined time after the supply of voltage to the heating elements 22, whereby the transfer ink 80 and the top coat layer 50*a* are firmly adhered to each other for solidification. Since the adhesion between the recording sheet 58 and the transfer ink 80 is weaker than the firm adhesion between the respective five layers 5*a* to 5*e* and the firm adhesion between the top coat layer 5*a* and the transfer ink 80 in this case, when the correctable ink ribbon 50 is separated from the recording sheet 58, the transfer ink 50 remains adhered to the ink ribbon 50 and thus removed from the recording sheet 58, as shown in FIG. 3 (*c*).

As shown in FIG. 4, a multi-time ink ribbon 51 (refer to Japanese Provisional Patent Publication Sho 61-68290) has a three-layer structure composed of a wax type ink layer 51*a* or the like, a base film 51*b*, and a sticking prevention layer 51*c*. Further, the ink layer 51*a* is provided with a so-called "stone wall" structure to enable characters to be printed by the multi-time ink ribbon 51 several times.

More specifically, since each of these one-time ink ribbon 49, correctable ink ribbon 50, and multi-time ink ribbon 51 has a specific ribbon structure, the kind and melting temperature of the ink and the transferability thereof are slightly different. Consequently, printing conditions such as a thermal head pressing force, a voltage applied to heating elements, an energizing time thereof, a ribbon exfoliating angle, and a printing speed must be individually set in accordance with the kind of ink ribbon used to effect printing, to obtain an optimum printing efficiency.

When a voltage is applied to the heating elements, the ink is melted and transferred onto a recording sheet. After predetermined time has passed, the heating elements are turned off and the melted ink begins to be solidified. In this case, as the carriage is being moved, the ink ribbon is left-adhered on the recording sheet without being depressed. As each layers of the ink ribbon has a different solidification time and a different adhesive characteristic, the interval between the beginning of solidification of the melted ink and exfoliation of the ink ribbon from the recording sheet affects the quality of printed or corrected character images. For example, in case of using the correctable ink ribbon 50 (FIG. 3), the ribbon 50 should be exfoliated after such time has passed that the transferred ink 80 on the recording sheet is left therefrom and sufficiently adhered onto the ribbon 50. This time interval is determined in accordance with the following two factors, that is, the speed of the carriage moved in the width direction of the recording sheet and the exfoliating angle formed by the recording sheet and the ink ribbon at the portion where the ink ribbon is exfoliated from the recording sheet. Assuming that the winding force of the ink ribbon is constant, the larger the exfoliating angle is, the larger the force vector is in the direction that the ribbon is away from the recording sheet. Further, the large the force vector in the direction that the ink ribbon is away from the recording sheet is, the easier it becomes to exfoliate the ink ribbon from the recording sheet against the adhesive force of the ink ribbon. Therefore, the time interval between beginning of solidification of the ink and exfoliation of the ink ribbon becomes short in this case. On the other hand, the smaller the exfoliating angle is, the smaller the force vector is, and the time interval becomes long.

Since the one-time ink ribbon 49 is used only for printing, preferably the ribbon exfoliating angle and pressing force are relatively large, and the ink is instantaneously melted by the application of a high voltage to ensure a sufficient transfer thereof to a sheet for printing. Further, although the multi-time ink ribbon 51 is also used only for printing, preferably the printing is carried out with a relatively small ribbon exfoliating angle and pressing force, so that the ink of the ink layer 51 can be used for more than one printing.

On the other hand, when printing with the correctable ink ribbon 50, by which a character may be deleted after it has been once printed, the printing conditions are preferably set in such a way that the stripping of ink transferred when an incorrect character has been printed on a sheet is improved.

Since, however, a conventional thermal printer assembled in an electronic typewriter or the like is not able to arbitrarily change the above printing conditions, the kind of ink ribbons able to be used for printing is specified for each type of machine.

Recently, a thermal printer by which a ink ribbon exfoliating angle of these printing conditions can be changed has been proposed. For example, Japanese Provisional Patent Publication Sho 62-30074 discloses a thermal printer wherein a lever is provided with guide pins for guiding a passage of a ink ribbon, and a thermal head is rotatably disposed at the rear edge of a carriage, the lever is turned in accordance with the flatness of a recording sheet, and thus the guide pins are moved to change the ink ribbon striping angle.

Since the above thermal printer disclosed in Japanese Provisional Patent Publication Sho 62-30074 is able to change only the ribbon exfoliating angle, when a ink ribbon to be used is changed., a pressing angle, a voltage applied to heating elements and an energizing time thereof cannot be changed, even though the ribbon exfoliating angle can be changed, and thus a problem arises in that a desired ink ribbon cannot be used in accordance with a printing object.

Since conventional thermal printers cannot change various printing conditions such as a ribbon exfoliating angle, pressing force and the like, when a ribbon other than a dedicated ribbon is used, the printing efficiency is greatly lowered and sometimes printing cannot be carried out. More specifically, a problem arises in that a ink ribbon cannot be arbitrarily selected in accordance with a printing object, and when printing is carried out using many kinds of ink ribbons, the thermal printer must be prepared in accordance with the kind of ribbon used and the like.

SUMMARY OF THE INVENTION

It is therefore an object of the invention to provide a thermal printer capable of changing printing conditions in accordance with a ink ribbon used.

To overcome the above object, according to the invention, there is provided a thermal printer comprising an ink ribbon, a platen, a thermal head confronting the platen, and a carriage supporting the thermal head and capable of reciprocally moving along the platen, ink on the ink ribbon being transferred, in accordance with image to be printed, by means of the thermal head onto a recording medium loaded on the platen, the printer comprises memory means having stored therein predetermined printing condition data corresponding to a plurality of print modes, the printing condition data being determined depending upon characteristics of a plurality of types of the ink ribbons, select means for selecting one of the plurality of print modes, and setting means for setting printing conditions based on the data stored in the memory means in accordance with the print mode selected by the select means.

DESCRIPTION OF THE ACCOMPANYING DRAWINGS

Figure 4:
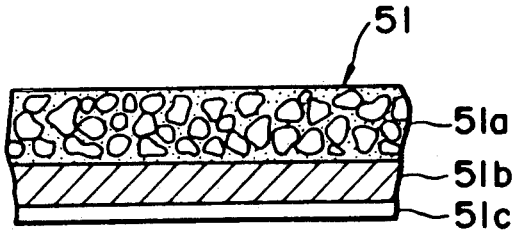
Figure 3A:
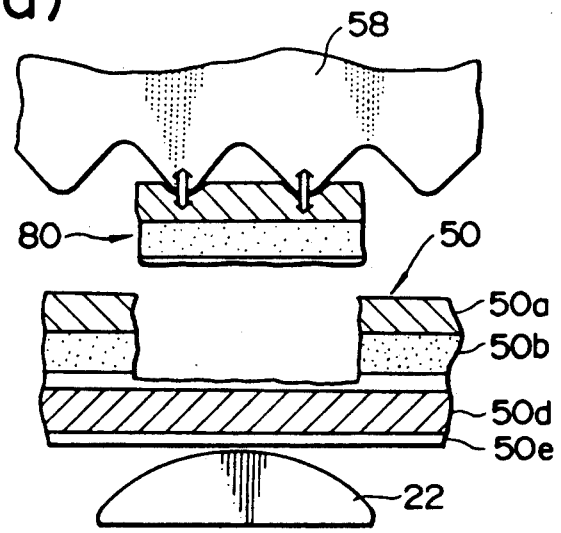
Figure 3B:
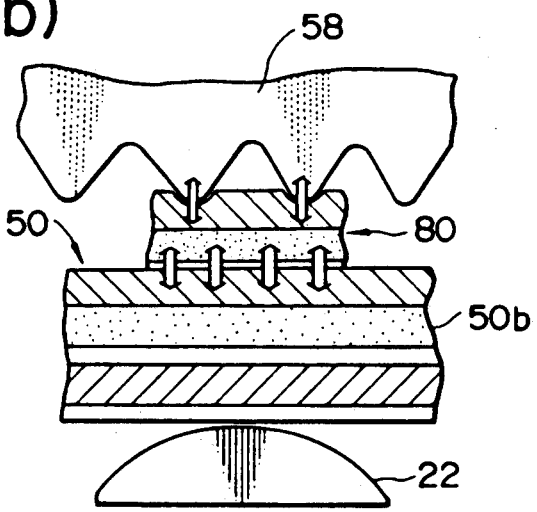
Figure 3C:
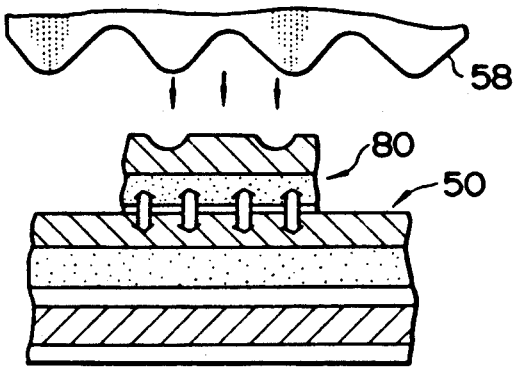
Figure 5:
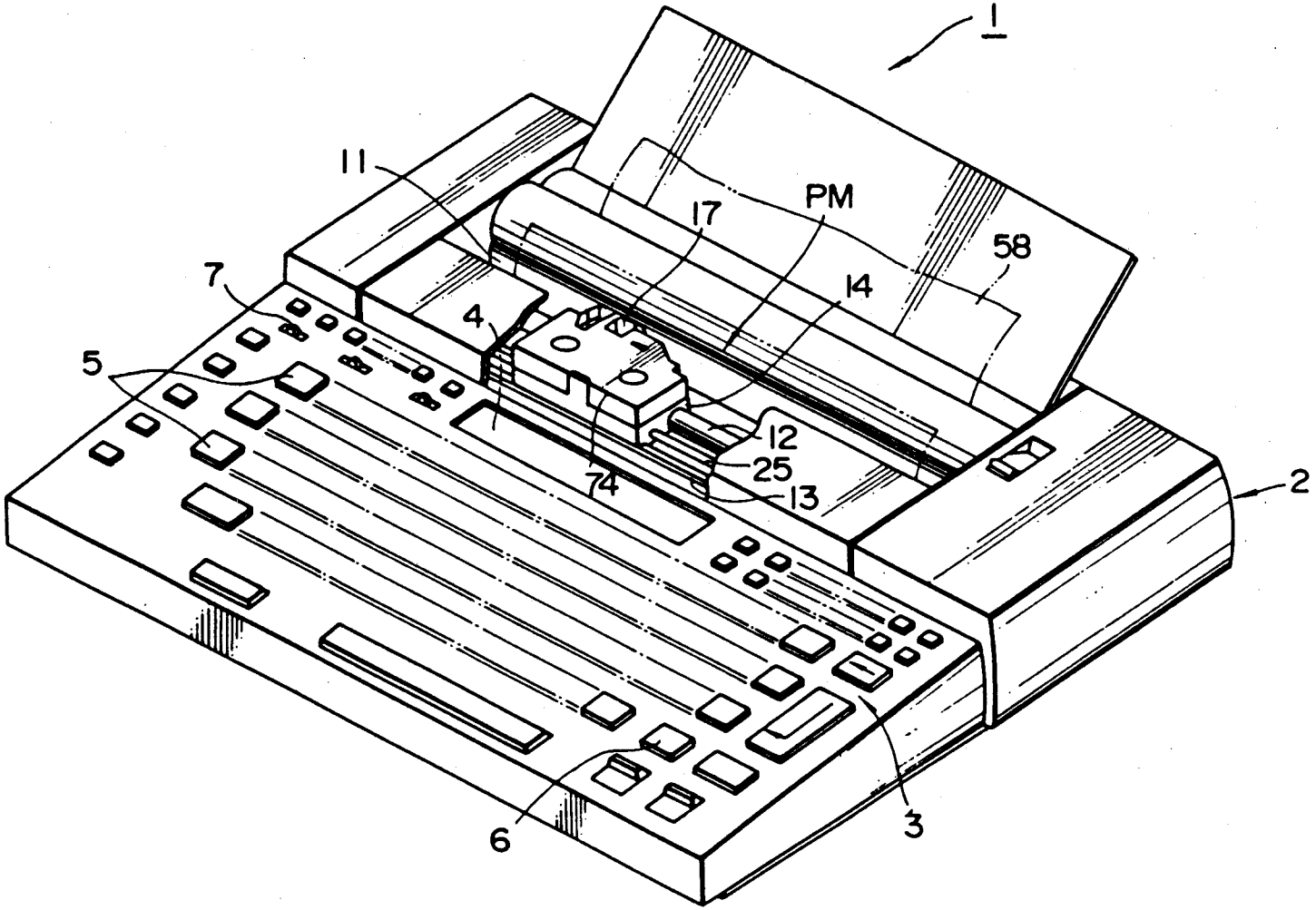
Figure 6:
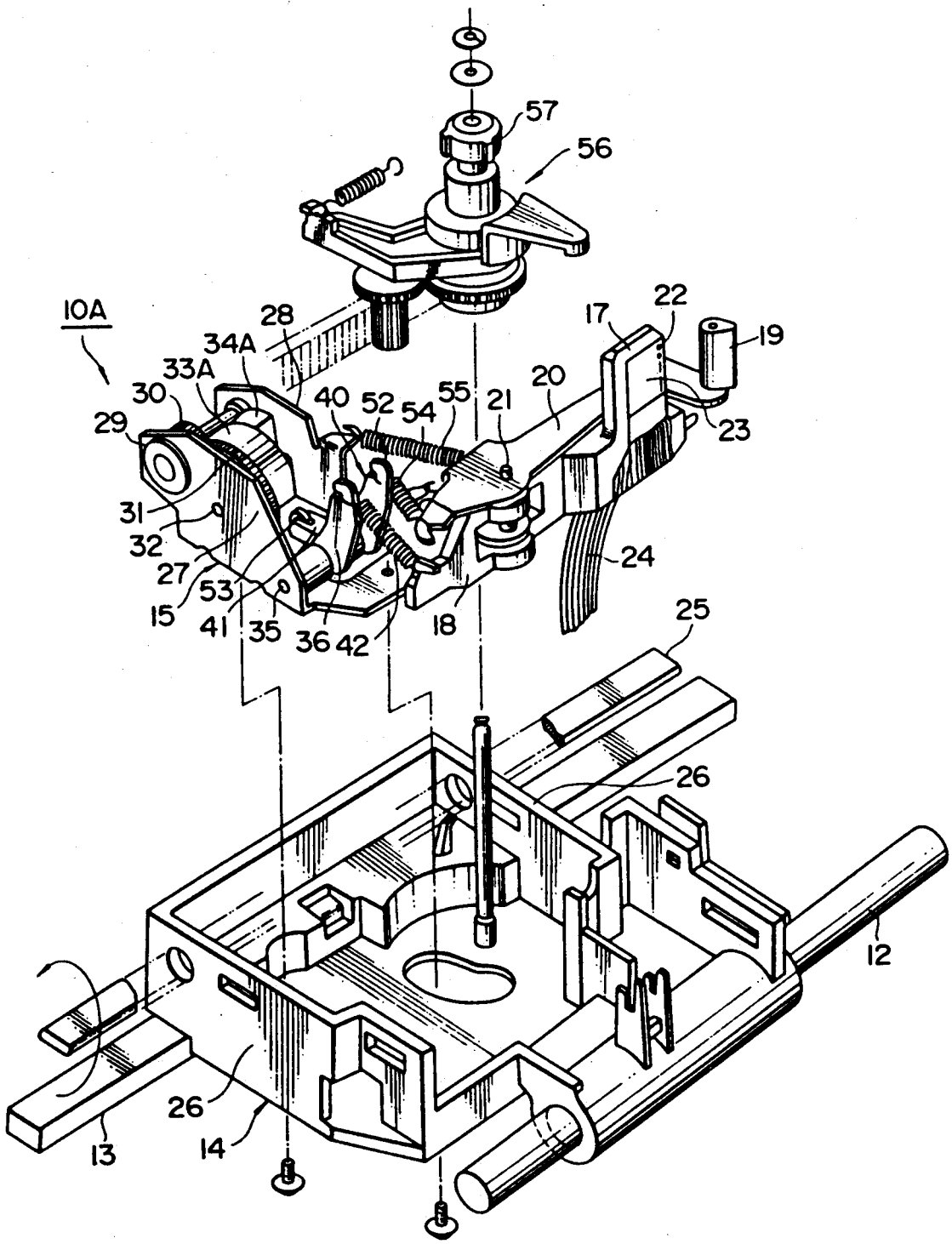
Figure 7:
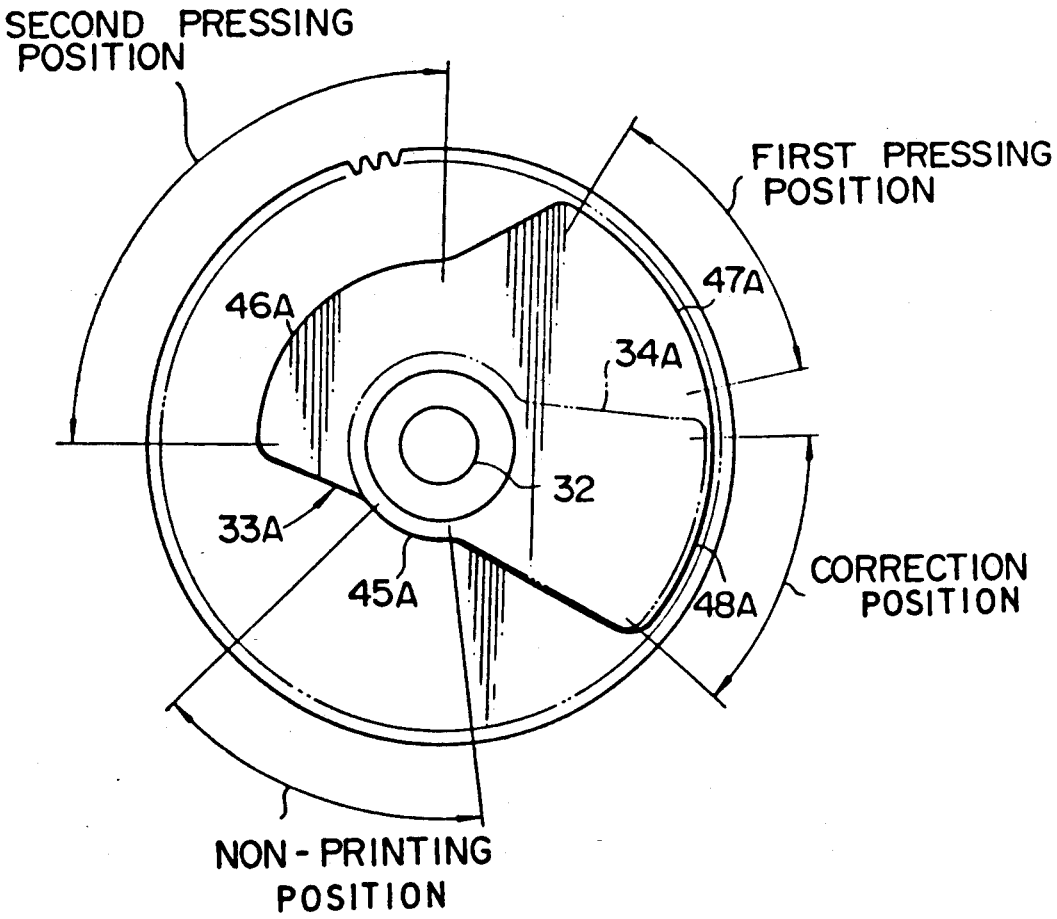
Figure 8:
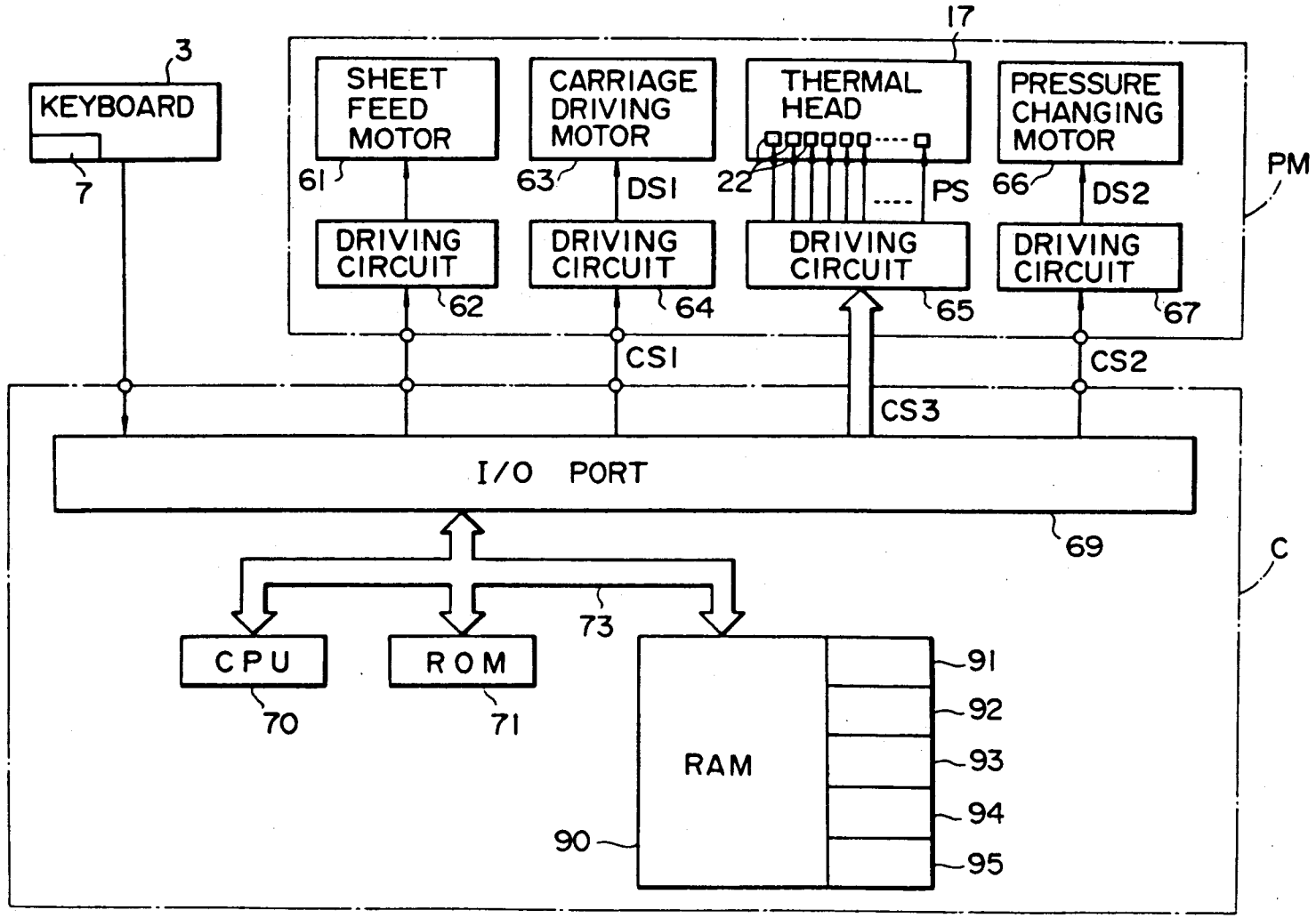
Figure 9:
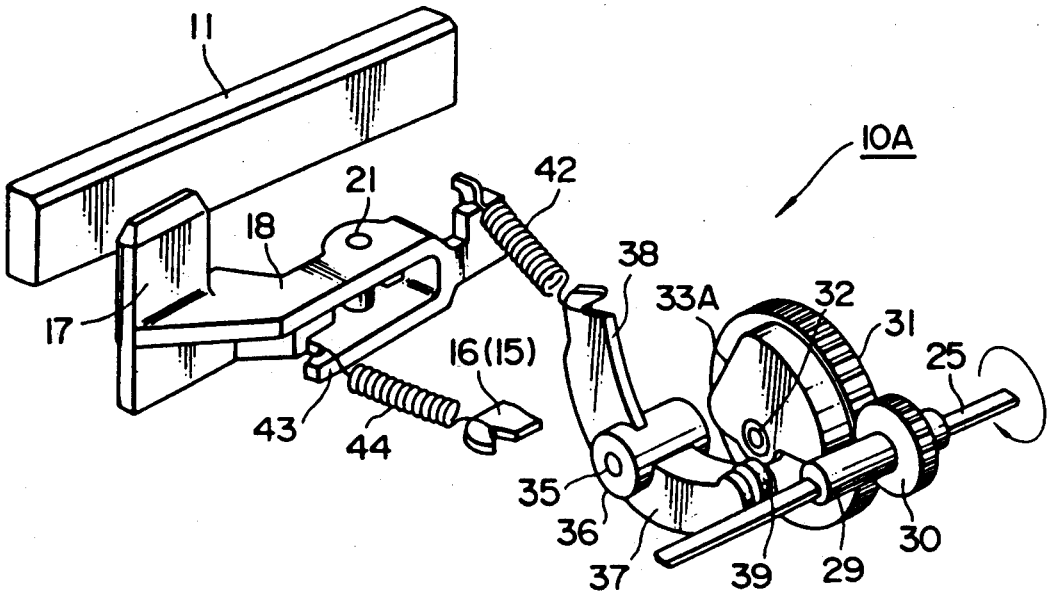
Figure 10:
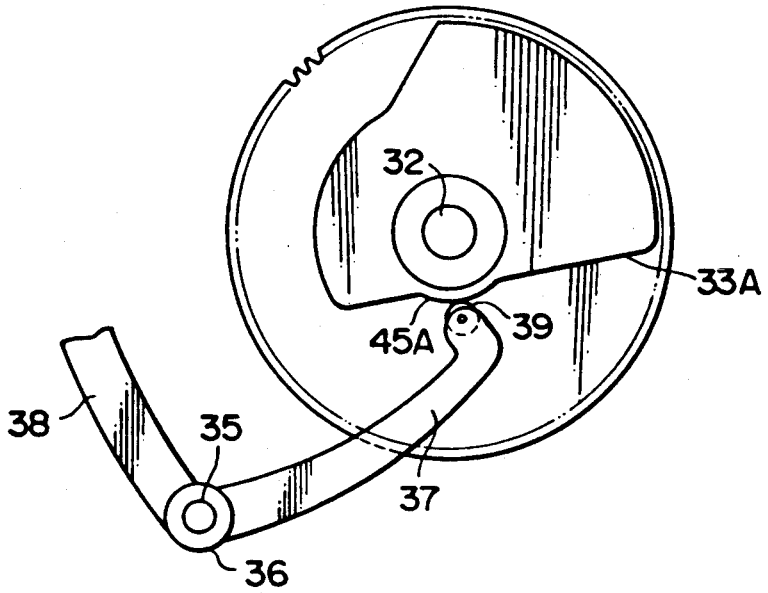
Figure 11:
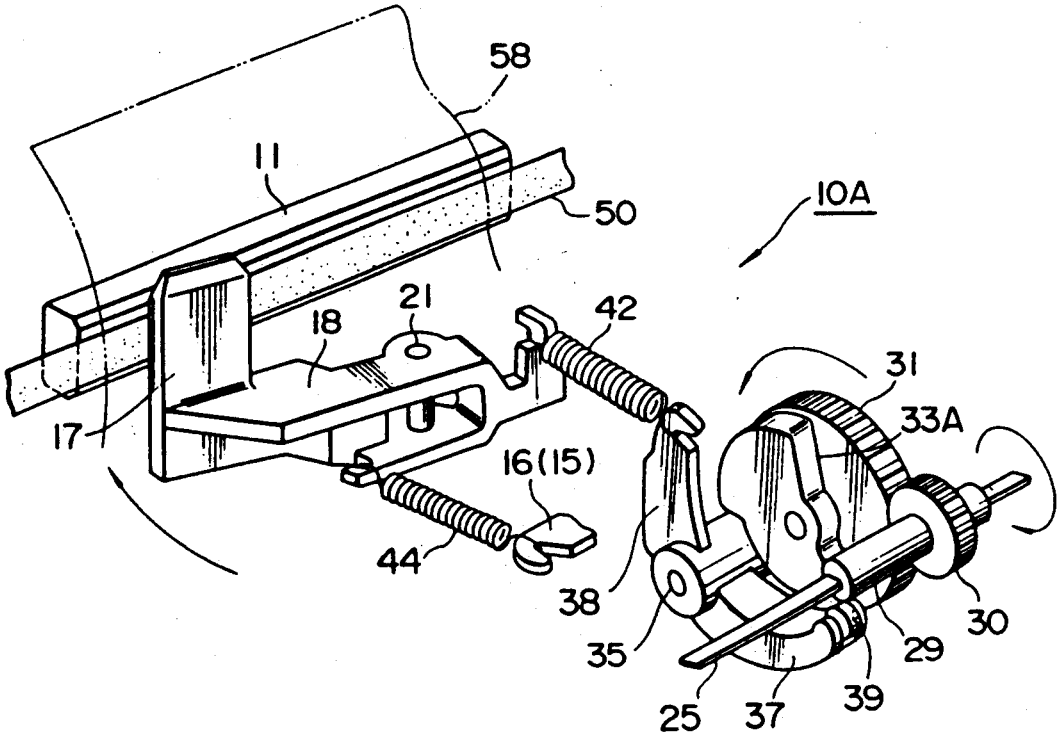
Figure 12:
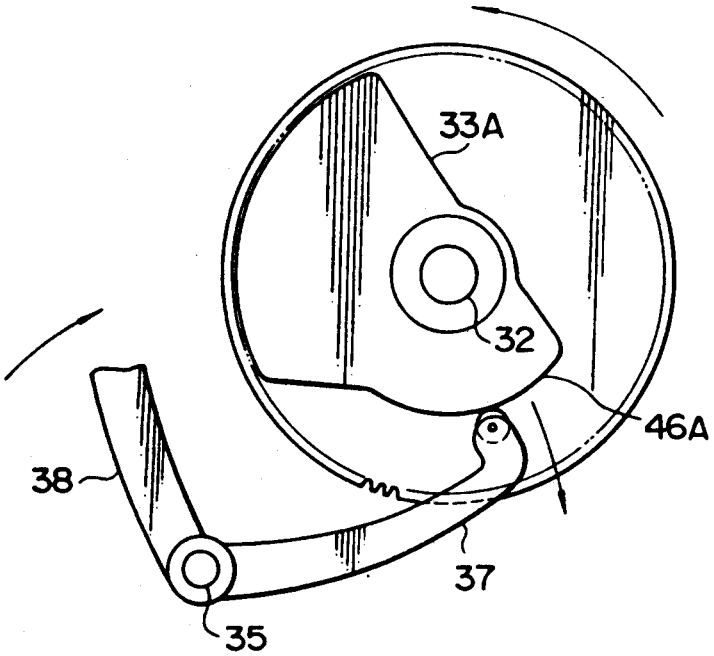
Figure 13:
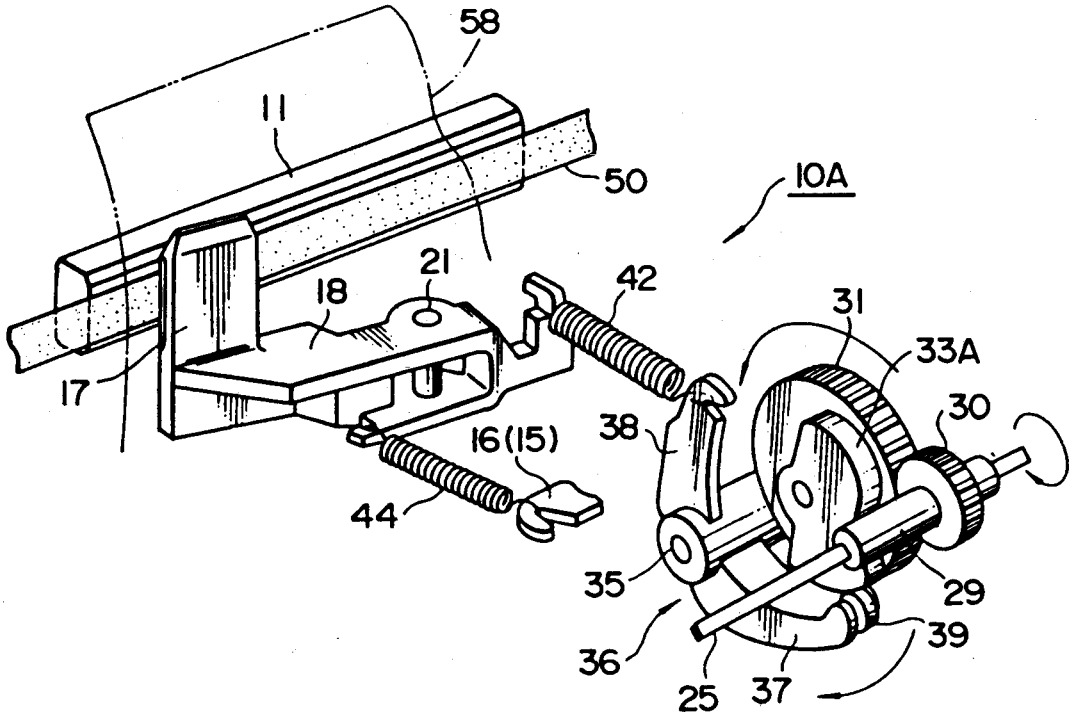
Figure 14:
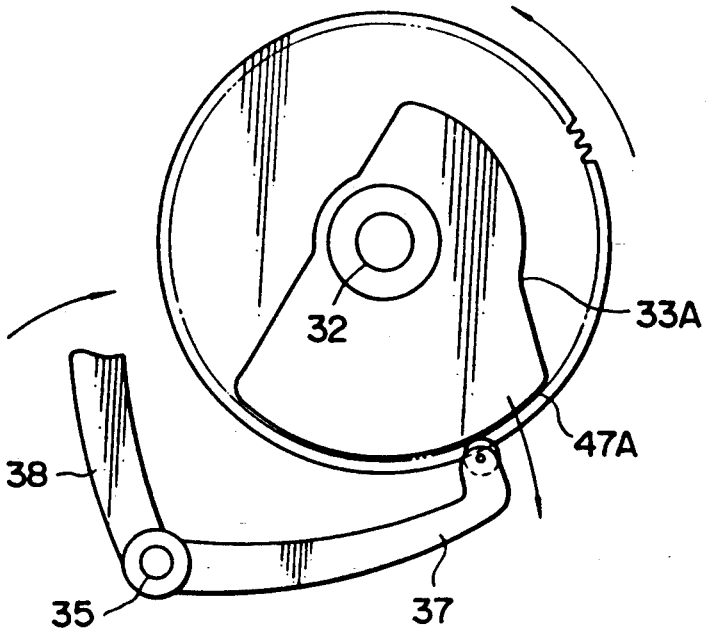
Figure 15:
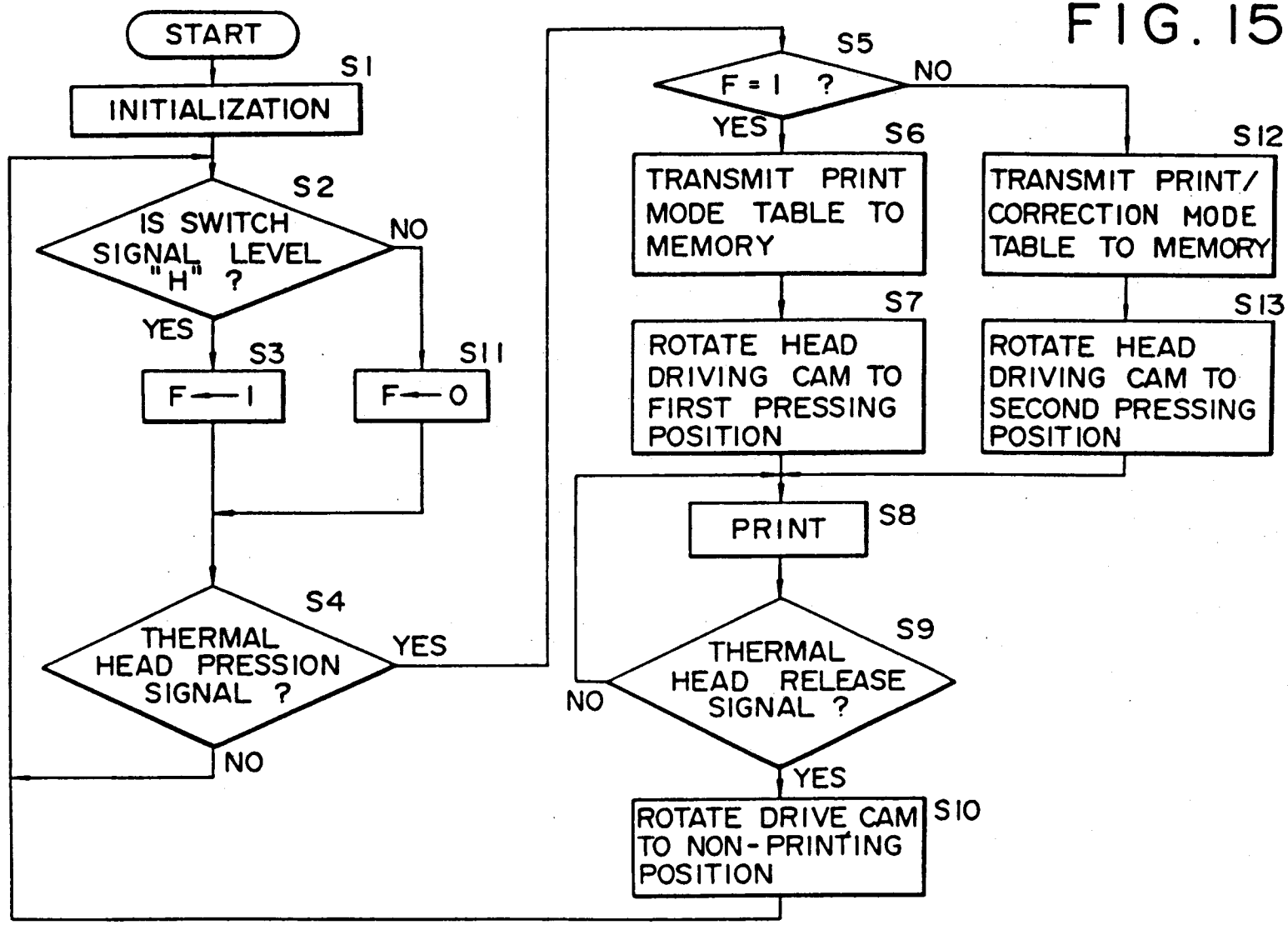
Figure 16:
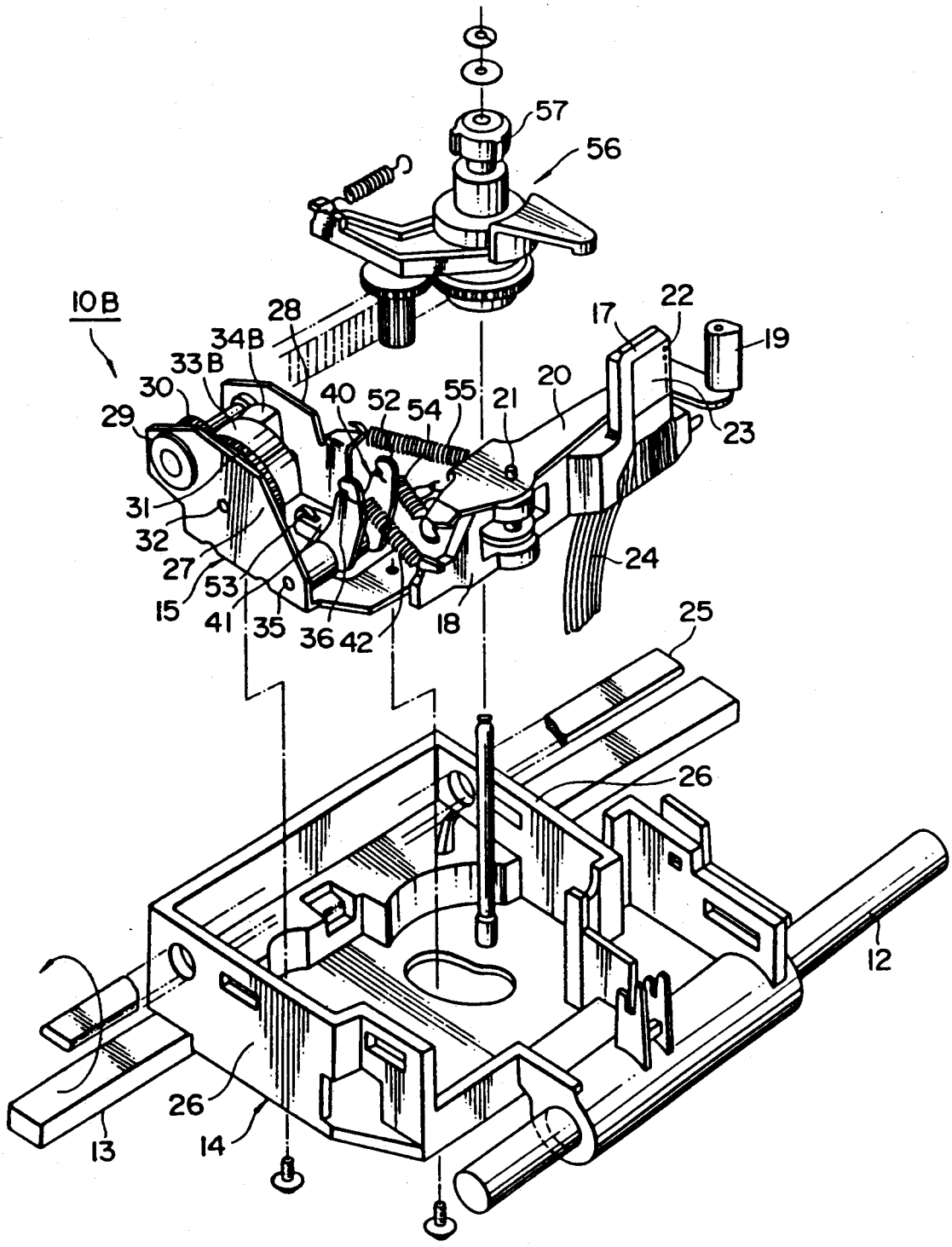
Figure 17:
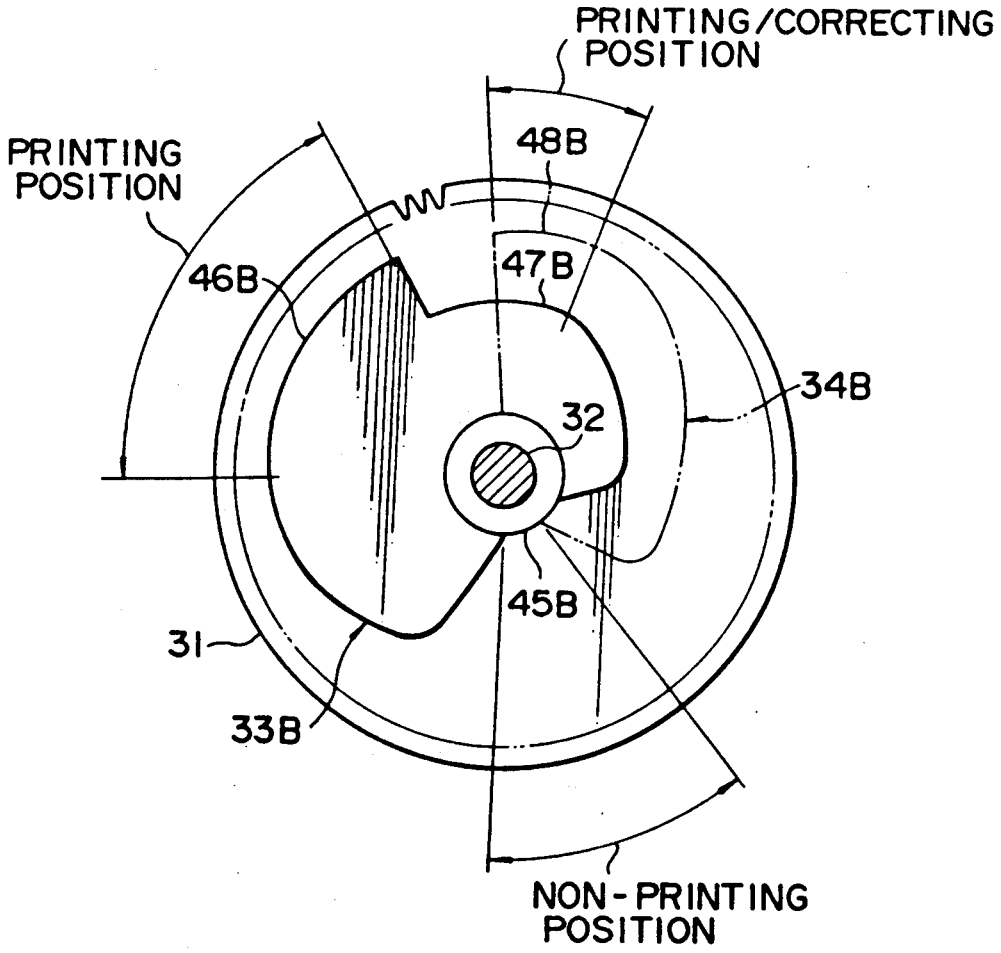
Figure 18:
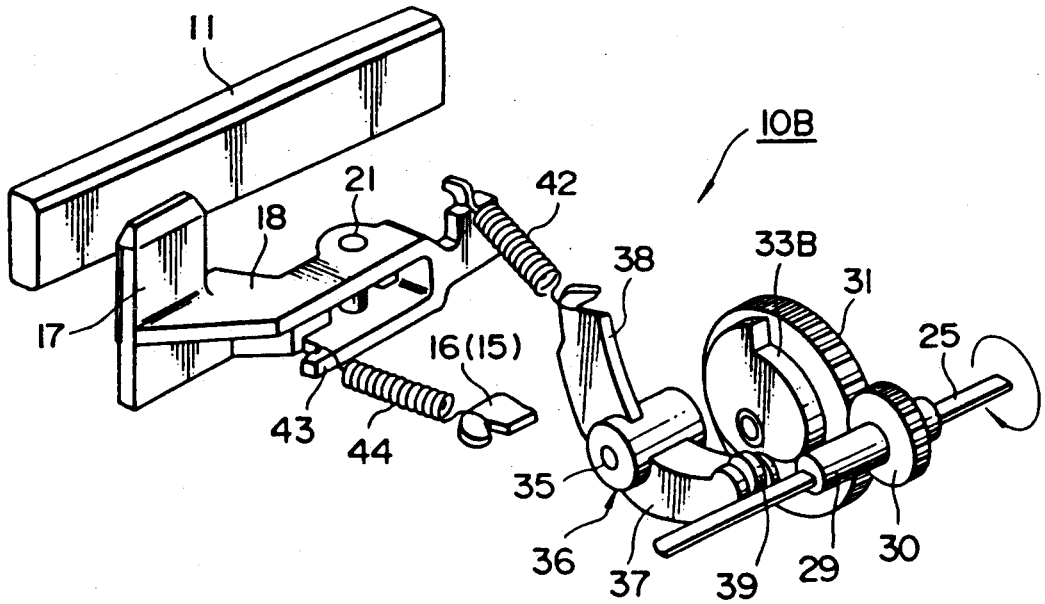
Figure 19:
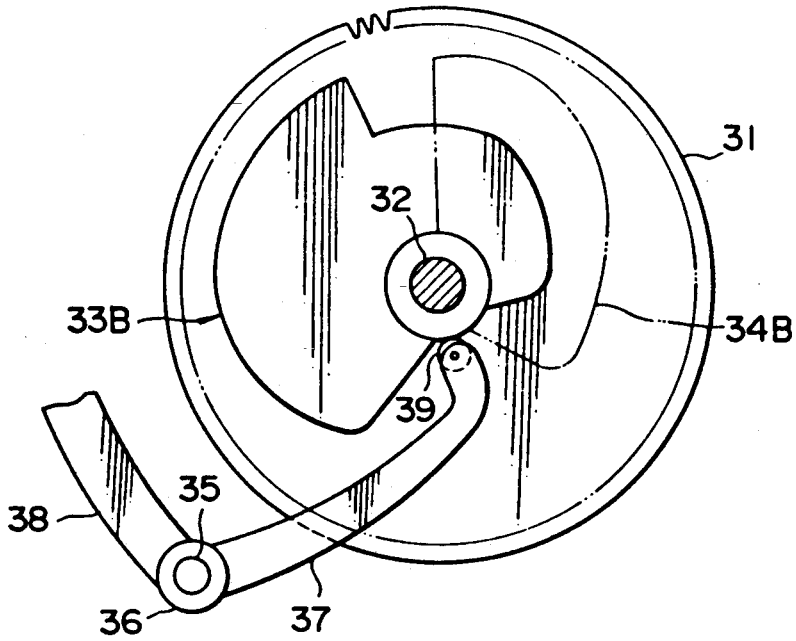
Figure 20:
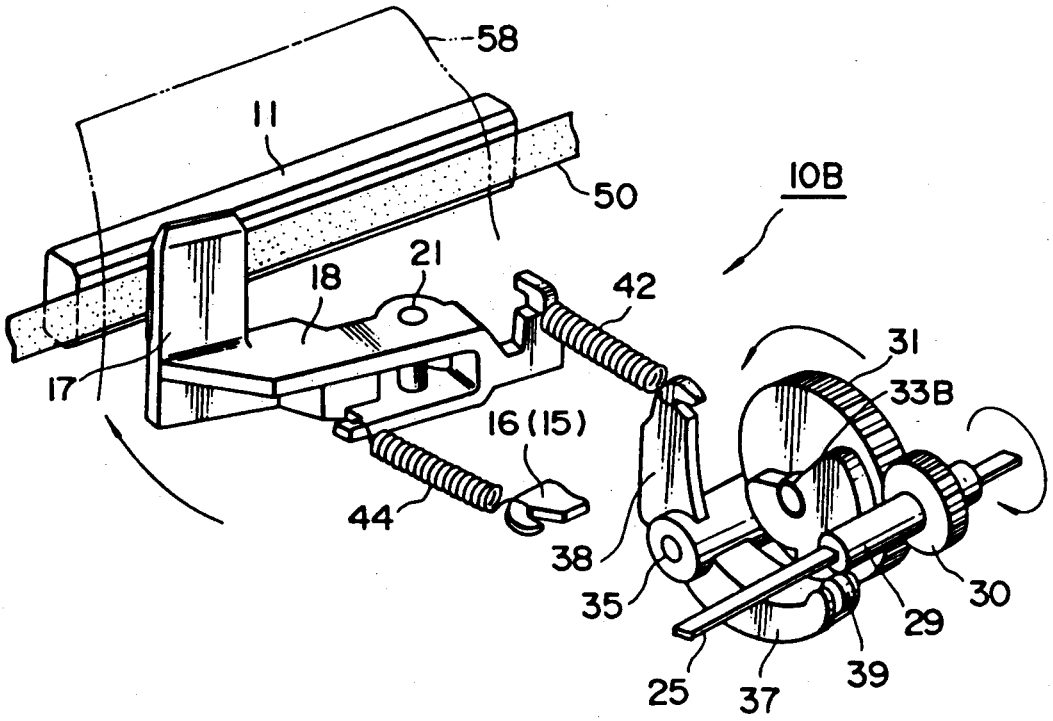
Figure 21:
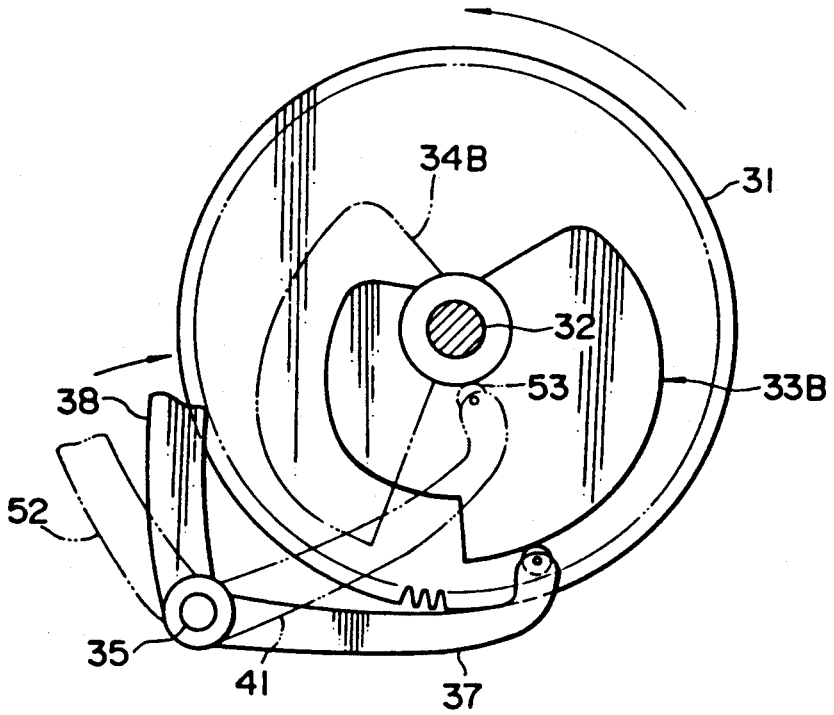
Figure 22:
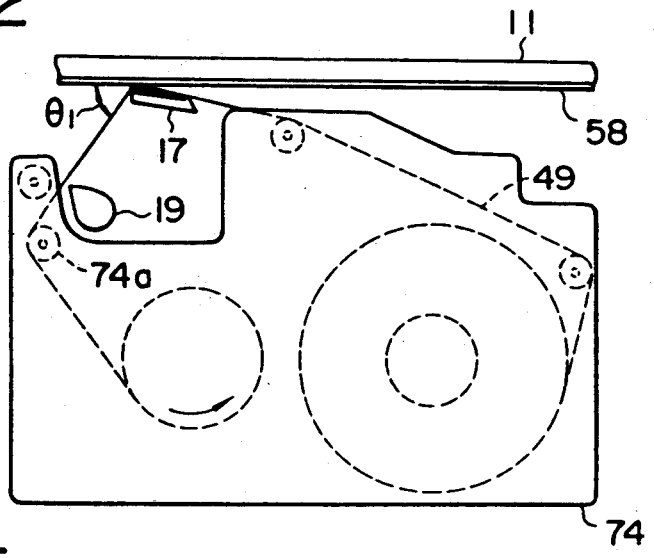
Figure 25:
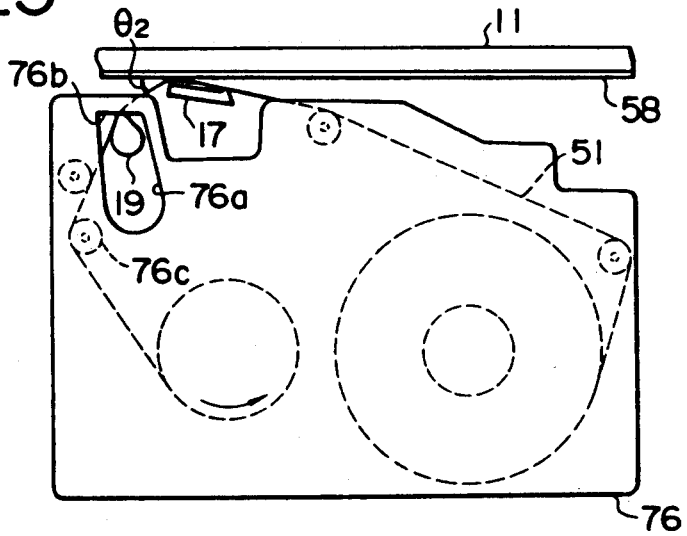
Figure 26:
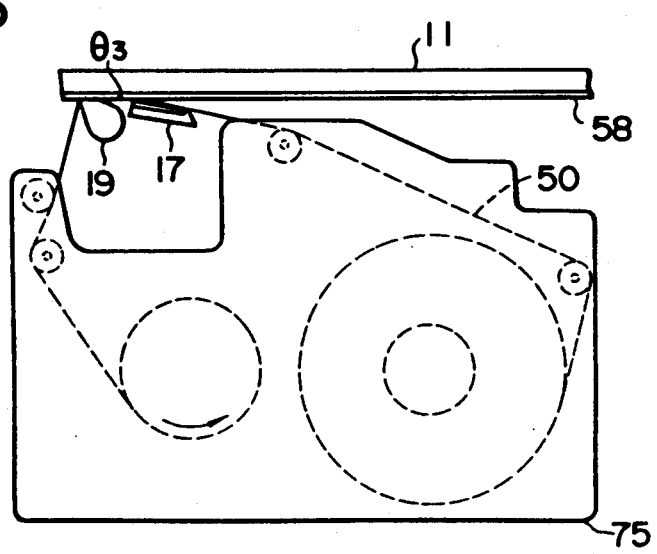
Figure 23:
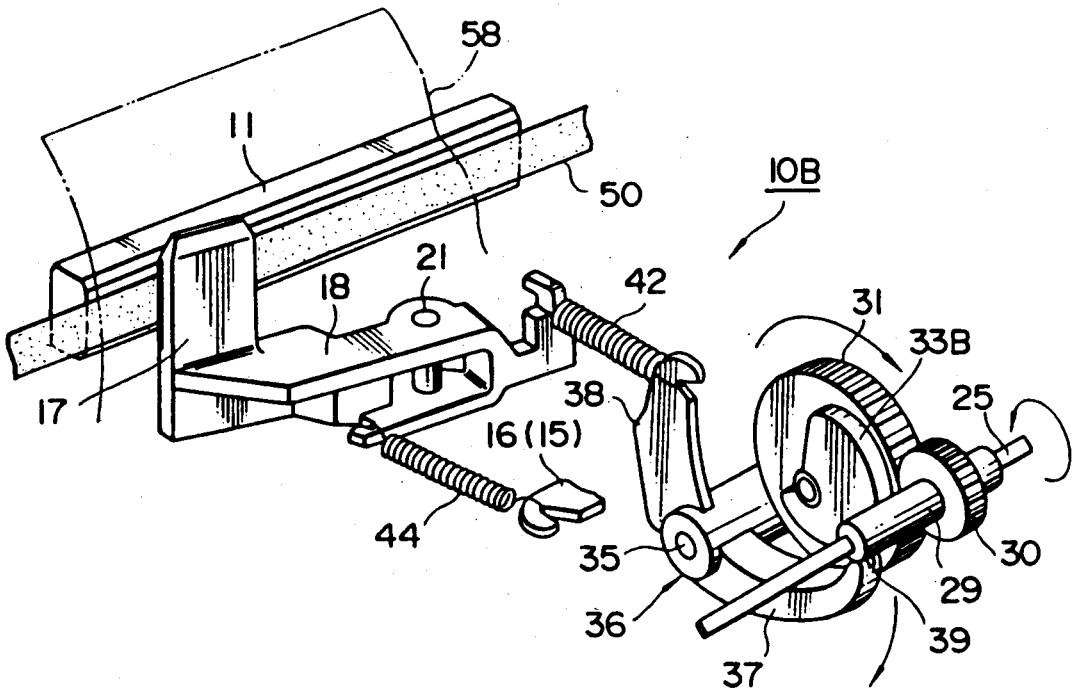
Figure 24:
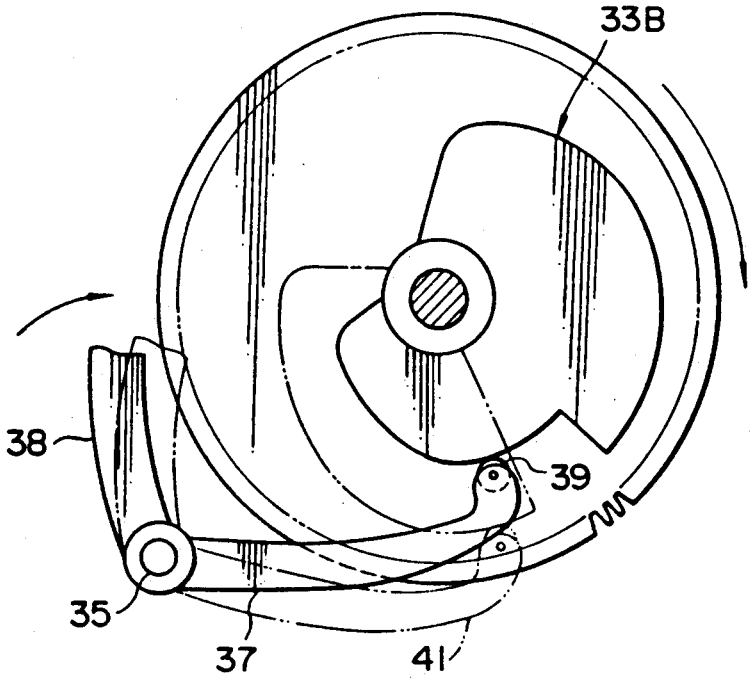
Figure 27A:
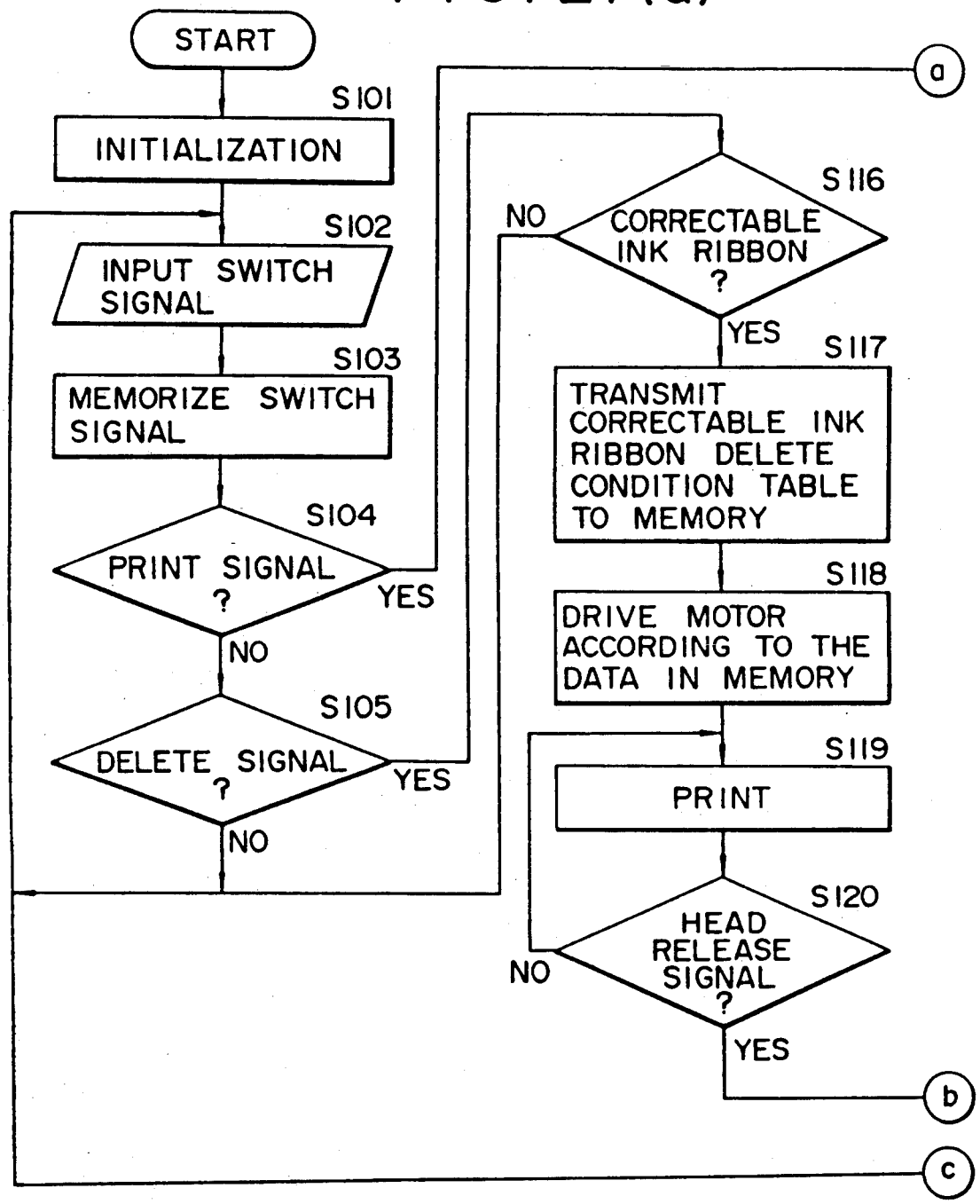
Figure 27:
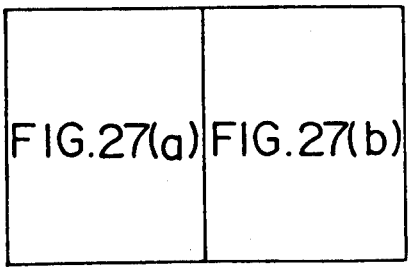
Figure 27B:
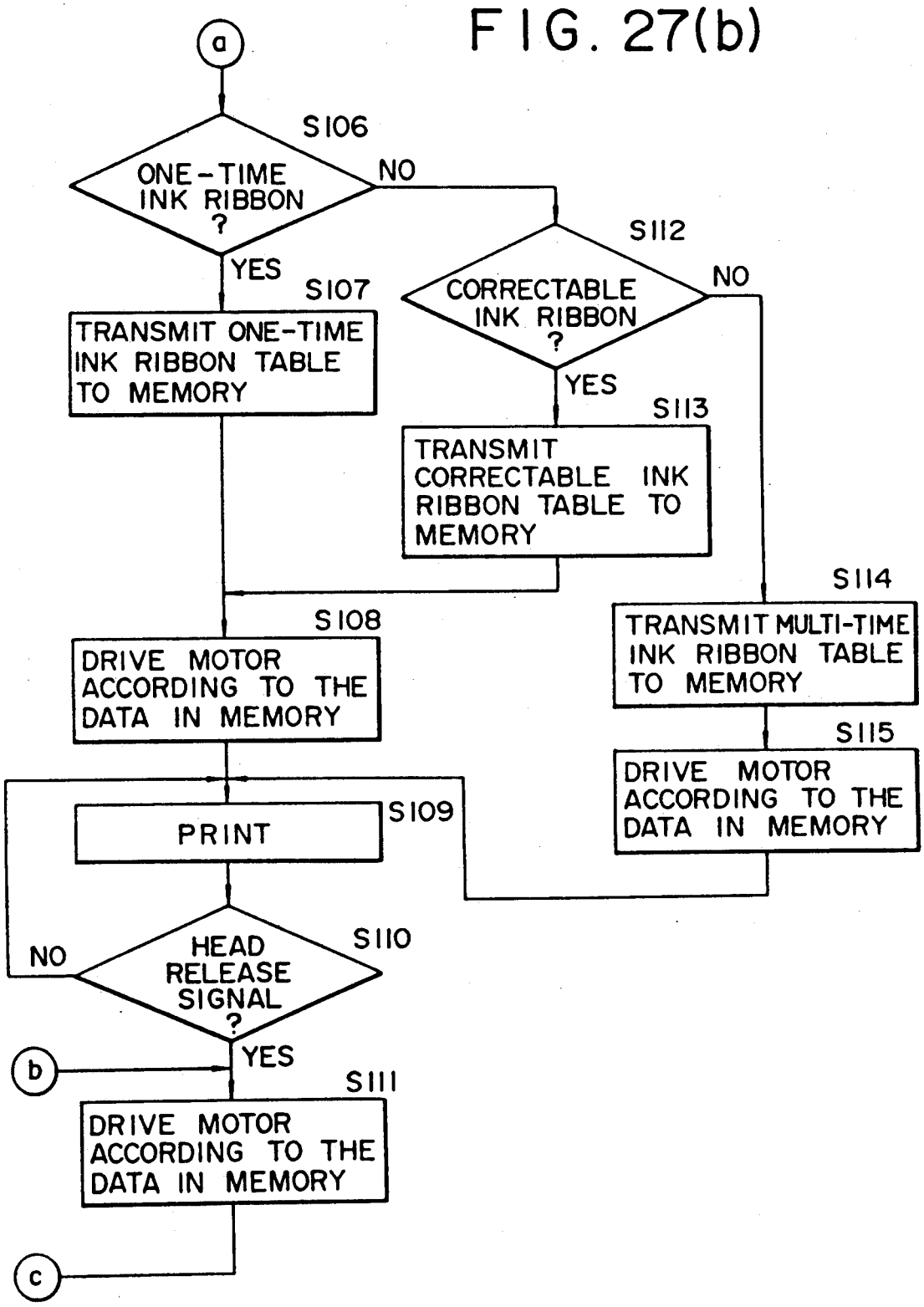

FIGS. 3 (*a*)–(*c*) are enlarged cross sectional views explaining the respective steps for printing and deleting a character by a correctable ink ribbon;

FIG. 4 is an enlarged horizontal cross sectional view of a multi-time ink ribbon;

FIG. 5 is a view of an electronic typewriter to which a thermal printer according to the present invention is applied;

FIG. 6 is an exploded perspective view of a pressure changing mechanism as an embodiment according to the present invention;

FIG. 7 is a side view of a head drive cam;

FIG. 8 is a block diagram of a control system of an electronic typewriter;

FIG. 9 is a schematic perspective view of the pressure changing mechanism when a thermal head is moved to a non-printing position;

FIG. 10 is a side view of a head drive cam and a head cam lever;

FIG. 11 is a schematic perspective view of the pressure changing mechanism when the thermal head is pressed against a platen by the second pressing force;

FIG. 12 is a side view of a head drive cam and a head cam lever shown in FIG. 11; FIG. 13 is a schematic perspective view of the pressure changing mechanism when the thermal head is pressed against a platen by the first pressing force;

FIG. 14 is a side view of a head drive cam and a head cam lever shown in FIG. 13;

FIG. 15 is a flowchart of the routine for controlling printing conditions to which the pressure changing mechanism is applied;

FIG. 16 is an exploded perspective view of a pressing force/exfoliating angle changing mechanism as a modification according to the present invention;

FIG. 17 is a side view of a head drive cam of the pressing force/exfoliating angle changing mechanism;

FIG. 18 is a schematic perspective view of the pressing force/exfoliating angle changing mechanism when the thermal head is moved to a non-printing position;

FIG. 19 is a side view of a head drive cam and a head cam lever shown in FIG. 18;

FIG. 20 is a schematic perspective view of the pressing force/exfoliating angle changing mechanism when the thermal head is moved to a pressing position to which a strong pressing force is applied;

FIG. 21 is a side view of a head drive cam and a head cam lever shown in FIG. 20; FIG. 22 is a plan view of a main part when printing is carried out using a one time ink ribbon;

FIG. 23 is a schematic perspective view of the pressing force/exfoliating angle changing mechanism when the thermal head is moved to a pressing position to which a weak pressing force is applied;

FIG. 24 is a side view of a head drive cam and a head cam lever shown in FIG. 23;

FIG. 25 is a plan view of a main part when printing is carried out using a multi-time ink ribbon;

FIG. 26 is a plan view of a main part when printing is carried out using correctable ink ribbon; and FIGS. 27 (*a*) and 27 (*b*) are a flowchart for controlling printing conditions of a digital typewriter to which the pressing force/exfoliating angle changing mechanism is applied.

DESCRIPTION OF THE EMBODIMENTS

FIG. 5 is a view of an electronic typewriter provided with a thermal printer as an embodiment according to the present invention.

As shown in FIG. 5, a keyboard 3 is disposed in front of a main body frame 2 of a typewriter 1, a printing mechanism PM is disposed in the main body frame 2 to be the rear of the keyboard 3, and a liquid crystal display 4 is disposed on the rear portion of the keyboard 3 to display input characters, symbols and the like.

The keyboard 3 is provided with character keys 5 including alphabet keys, numeral keys and symbol keys, a correction key 6 for deleting a character, and various function keys as provided for a usual typewriter.

Further, there is provided a print mode setting switch 7 for selectively switching and setting a print mode. In the present embodiment, a print only mode can be switched to a print/correction mode, in which a character can be deleted after it has been printed, and vise versa.

Next, the printing mechanism PM including a pressure changing mechanism 10 corresponding to a pressure changing means will be described with reference to FIGS. 5 through 13.

A platen 11 extending to the right and left is supported at the rear side of the main body frame 2, and a guide bar 12 and a guide plate 13 are disposed in front of the platen 11. A carriage 14 is reciprocally movably supported along the platen 11, to the right and left, in such a manner that the guide bar 12 passes through the support portion at the rear edge thereof and the stepped portion at the front edge thereof is in sliding contact with the guide plate 13, and is driven by a carriage drive motor 63 (refer to FIG. 8) composed of a stepping motor through a wire, not shown.

A sheet feed roller, not shown extending to the right and left is disposed at a position just behind and below the platen 11, and is driven by a sheet feed motor 61 (refer to FIG. 8).

As shown in FIG. 6, a pressure changing mechanism 10A and a ribbon winding mechanism 56 are mounted in the carriage 14. Note, FIG. 6 shows an exploded perspective view of the carriage shown in FIG. 5 when viewed from the rear side thereof, and thus the forward, rearward, rightward, and leftward directions in FIG. 6 are the reverse of those as shown in the other figures.

To describe the pressure changing mechanism 10A, a head lever 18 having a thermal head 17 mounted at the left end thereof, and a blade lever 20 having a correction blade 19 mounted at the left end thereof, are horizontally pivotally supported by a support pin 21 at the rear end of a unit frame 15 disposed in the carriage 14.

A head board 23, on which a plurality of heating elements 22 adjacent to each other are arranged in a vertical single column, is attached on the back of the thermal head, and these heating elements 22 are coupled with a drive circuit 65 (refer to FIG. 8) through signal lines 24.

A flat-shaped drive shaft 25 passing through the rear end of the carriage 14 and extending to the right and left passes through both the right and left walls 26 of the carriage 14 and a pair of confronting side walls 27 and 28 formed at the front side of the unit frame 15 and coupled with a pressure changing motor 66 (refer to FIG. 8) at the left end thereof. As shown in FIG. 8, a sleeve 29 is slidingly interposed between the pair of the side walls 27 and 28 of the drive shaft 25, and a drive gear 30 fixed at a position adjacent to the right end of the sleeve 29 can be rotated through the sleeve 29 by the rotation of the drive shaft 25 and moved to the right and left through the sleeve 29 by the right and left movement of the carriage 14.

As shown in FIG. 6, a cam gear 31 disposed just behind the drive gear 30 is pivotally supported by a pin 32 fixed to the side wall 27 and meshed with the drive gear 30. A head drive cam 33A is fixed on the left surface of the cam gear 31, and a blade drive cam 34A (refer to FIG. 7) is fixed on the side wall 28 surface side of the head drive cam 33A.

A support shaft 35 parallel to the drive shaft 25 is fixed to the side wall 27 at a position behind the cam gear 31, and the base portion of a head cam lever 36 is pivotally supported by the support shaft 35 at a position confronting the head drive cam 33A. The base portion of a blade cam lever 40 is pivotally supported by the support shaft 35 at a position confronting the blade drive cam 34A.

The head cam lever 36 has a pair of arms 37 and 38 having an opening angle of 110° formed radially from the base portion thereof, respectively, whereby a roller 39 at the extreme end of the arm 37 can be held in abutment against the cam surface of the head drive cam 33A, and a stretch spring 42 is stretched between the extreme end of the arm 38 and the right end of the head lever 18. The stretch spring 42 is a contact spring to which a predetermined compressed preload is applied, and thus when a load exceeding the preload is applied thereto, the spring 42 is elastically deformed. Further, as shown in FIG. 8, a stretch spring 44 is stretched between the lug 43 of the head lever 18 and the lug 16 of the unit frame 15. The stretch spring 44 is applied with a predetermined preload to stably hold the thermal head 17 at a release position (non-printing position) shown in FIG. 8, and has a spring force weaker than the preload set to the stretch spring 42.

As shown in FIG. 7, the first operating cam surface 45A, the second operating cam surface 46A, the third operating cam surface 47A, and the fourth operating cam surface 48A are successively formed on the head drive cam 33A and the cam distances from the center of the pin 32 to the respective cam operating surfaces 45A, 46A, 47A, and 48A satisfy the following relationship.

$$C1 < C2 < C3 = C4$$

wherein,

C1: a cam distance of the first operating cam surface 45A

C2: a cam distance of the second operating cam surface 46A

C3: a cam distance of the third operating cam surface 47A

C4: a cam distance of the fourth operating cam surface 47A

The first operating cam surface 45A is used to hold the thermal head 17 at the release position, and a position to which the head drive cam 33A is rotated when the roller 39 of the arm 37 is held in abutment against the first cam operating surface 45A is called the non-printing position. The second operating cam surface 46A, formed to follow the first operating cam surface 45A is, used to press the thermal head 17 against the platen 11 with a relatively weak pressing force of about 400 gf (the second pressing force) when printing is carried out in a print/correction mode, and a position to which the head drive cam 33A is rotated when the roller 39 of the arm 37 is held in abutment against the second cam operating surface 46A, is called the second pressing position. The third operating cam surface 47A, formed to follow the second operating cam surface 46A is, used to press the thermal head 17 against the platen 11 with a strong pressing force of about 800 gf (the first pressing force) when printing is carried out in a print only mode, and a position to which the head drive cam 33A is rotated when the roller 39 of the arm 37 is held in abutment against the third cam operating surface 47A is called the first pressing position. Note that the fourth operating cam surface 48A is used to press the thermal head 17 against the platen 11 when a character is corrected.

The blade cam lever 40 has a pair of arms 41 and 52 having an opening angle of 110° formed radially from the base portion thereof, respectively, similar to the head cam lever 36, whereby a roller 53 at the extreme end of the arm 41 can be held in abutment against the cam surface of the blade drive cam 34A, and a stretch spring 54 is stretched between the extreme end of the arm 52 and the right end of the blade lever 20. The stretch spring 54 is similar to the stretch spring 42 and is in a contact state with a predetermined compressing preload applied thereto, and thus is elastically deformed when a load exceeding the preload is applied thereto. Further, a stretch spring 55 fitted between the lugs of the blade lever 20 and the unit frame 15 and having a predetermined preload, stably holds a non-deleting unit for separating the correction blade 19 from the platen 11, and is set to a spring force weaker than the preload set to the stretch spring 54.

The blade drive cam 34A has substantially the same cam surface as the fourth operating cam surface 48A of the head drive cam 33A, and the same phase as that of the fourth operating cam surface 48A, as shown by a two-dot-and-dash line in FIG. 3.

Note, since the ribbon winding mechanism 56 is similar to a mechanism including a winding spool 57 provided with a usual typewriter, a detailed description thereof is omitted.

A recording sheet 58 is fed between the platen 11 and the thermal head 17 by a sheet feed roller driven by a sheet feed motor 61, and a correctable ribbon cassette 74, onto which a correctable ink ribbon 50 capable of deleting a character is wound, is detachably mounted on the carriage 14. The ink ribbon 50 wound onto the feed spool of the correctable ribbon cassette 74 is wound onto a winding spool through the space between the thermal head 17 and the recording sheet 58.

Figure 1:
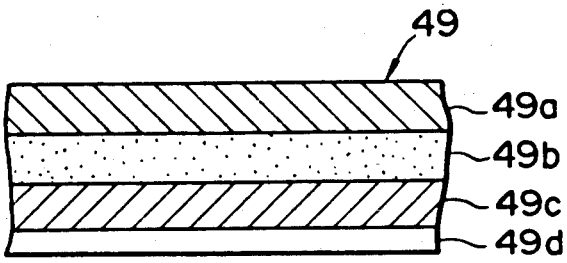
FIG. 1 is an enlarged horizontal cross sectional view of a one time ink ribbon.
Figure 2:
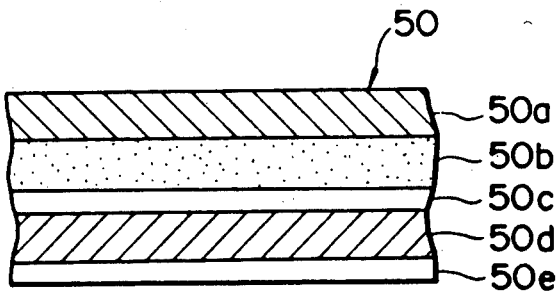
FIG. 2 is an enlarged horizontal cross sectional view of a correctable ink ribbon.

As described above with reference to FIG. 2, the correctable ribbon 50 has a five-layer structure composed of the top coat layer 50*a*, the ink layer 50*b*, the exfoliation layer 50*c*, the base film 50*d*, and the sticking prevention layer 50*e*.

Next, the overall arrangement of the control system of the electronic typewriter 1 will be described with reference to FIG. 9.

The electronic typewriter 1 fundamentally comprises the keyboard 3, the printing mechanism PM, a display mechanism (not shown), a control unit C and the like: the keyboard 3, the printing mechanism PM, and the display mechanism being connected to the input/output port (I/O port) 69 of the control unit C.

In the printing mechanism PM, the sheet feed motor 61, the carriage drive motor 63, the heating elements 22 of the thermal head 17, and the pressure changing motor 66 are connected to the I/O port through drive circuits 62, 64, 65, and 67, respectively. The print mode setting switch 7 provided at the keyboard 3 outputs an "H" level switch signal when switched to a print only mode and an "L" level switch signal when switched to a print/correction mode.

The control unit C comprises a CPU 70, the I/O port 69 connected to the CPU 70 through a bus such as a data bus, a ROM 71, and a RAM 90.

The ROM 71 stores a multiplicity of dot pattern data, a printing condition control program for controlling a printing operation by printing conditions corresponding to a print only mode or print/correction mode, a character print control program, a character deletion control program, and the like.

The above printing condition control program stores (i) a print mode table for setting printing conditions for printing characters in a print only mode, and (ii) a print/correction mode table for setting printing conditions for printing characters in a print/correction mode, in accordance with the mode set.

Table 1 shows the printing conditions for the print only mode and the print/correction mode.

TABLE 1

| | A | B | C | D | E |
|---|---|---|---|---|---|
| print mode | 15 | 800 | 12 | 510 | 39 |
| print/correction mode | 30 | 400 | 9 | 850 | 24 |

In Table 1, A designates a printing speed (characters/sec), B designates a pressing force (gf) of a thermal head 17, C designates a voltage (V) applied to the heating elements 22, D designates an energizing time (μsec), and E designates an energy (mj/mm$^2$) applied to the heating elements 22. Note, the printing conditions shown in Table 1 are set in consideration that a printing performance is more greatly affected by the sequence of a printing speed≧a head pressing force>>an applied voltage and energizing time, and a deleting performance is more greatly affected by the sequence of a printing speed>>head pressing force>an applied voltage and energizing time.

The print mode table stores (1) control frequency data for controlling the carriage drive motor 63 to effect a printing operation at a print speed of 15 characters/sec: (2) first pulse number data for driving the pressure changing motor 66 to rotate the head drive cam 33A from the non-printing position shown in FIG. 10 to the first pressing position shown in FIG. 12, to set a pressing force of the thermal head 17 to about 800 gf: and (3) voltage application instruction data for producing an instruction to apply a voltage (pulse voltage) of 12 V from the drive circuit 65, (4) energizing time (pulse width) data for applying a voltage for 510 μsec, and the like.

The print/correction mode table stores (1) control frequency data for controlling the carriage drive motor 63 to effect a printing operation at a print speed of 30 characters/sec: (2) second pulse number data for driving the pressure changing motor 66 to rotate the head drive cam 33A from the non-printing position shown in FIG. 10 to the second pressing position shown in FIG. 14, to set a pressing force of the thermal head 17 to about 400 gf: (3) voltage application instruction data for producing an instruction to apply a voltage (pulse voltage) of 9 V from the drive circuit 65, (4) energizing time (pulse width) data for applying a voltage for 850 μsec, and the like.

Therefore, when the print control is executed, the I/O port 69 applies a control signal CS1 to the drive circuit 64, and the drive circuit 64 applies a drive signal DS1 to the carriage drive motor 63. Further, the I/O port 69 applies a control signal CS3 to the drive circuit 65 based on the voltage application instruction data and the energizing time data, and the drive circuit 65 applies a pulse signal PS to all or a part of the multiple heating elements 22. Further, the I/O port 69 applies a control signal CS2 to the drive circuit 67 based on the pulse number data, and the drive circuit 67 applies a drive signal DS2 to the pressure changing motor 66.

The RAM 90 stores a print mode memory 91 for storing a mode flag F, which is set when the print mode setting switch 7 is switched to the print only mode and reset when the switch 7 is switched to the print/correction mode, a control frequency data memory 92 for storing the control frequency data, the pulse number data, the voltage application instruction data and the energizing time read out from the above table, respectively, a pulse number data memory 93, a voltage application instruction data memory 94, an energizing time data memory 95, and the like.

Next, a routine of controlling the printing conditions effected by the control unit C of the electronic typewriter 1 will be described with reference to a flowchart of FIG. 15.

When the typewriter 1 is switched on, and the print condition control process is started, the initialization thereof is effected at step S1 (hereinafter, simply referred to as S1; this also refers to all other steps). At S1, the pressure changing motor 66 is initialized, the head drive cam 33 is rotated to the non-printing position as shown in FIG. 10, but the arm 37 is not rotated below the first operating cam surface 45. Accordingly, the stretch spring 44 has a spring force greater than that of the stretch spring 42, and thus the thermal head 17 is held at the release position.

Next, at S2 it is determined whether or not a switch signal produced by the print mode setting switch 7 provided with the keyboard 3 is at an "H" level. Namely, when the print mode setting switch 7 is switched to the print only mode, the switch 7 produces an "H" level switch signal and thus the determination at S2 is YES and at S3 the mode flag F in the mode flag memory 9 is set to 1.

On the other hand, when the print mode setting switch 7 is switched to the print/correction mode, the switch 7 produces an "L" level switch signal, and thus the determination at S2 is NO and accordingly the mode flag F is reset at S11. Next, at S4 it is determined whether or not the CPU 70 has detected a head pressing instruction signal. If the CPU 70 has not detected this signal, steps S2 to S4 are repeated. Namely when the character keys 5 or the print key are operated through the keyboard 3, the CPU 70 detects the head pressing instruction signal based on the control program stored in the ROM 71, and thus the determination at S4 is YES. When the mode flag F is set, the determination at S5 is YES, and thus at S6 the data stored in the print mode table of the ROM 71 is read out and written to the predetermined memories 92 to 95 in the RAM 90.

Next, the CPU 70 applies the control signal CS2 to the drive circuit 67 through the I/O port 69, based on the second pulse number data stored in the pulse number data memory 93, and the drive circuit 67 applies the drive signal DS2 to the pressure changing motor 66, whereby, at S7, the motor 66 is driven for a predetermined number of rotations. As a result, a drive shaft 25 is rotated in the direction of an arrow in FIG. 13, and thus the head drive cam 33 is rotated to the first pressing position shown in FIG. 14, and therefore the stretch spring 42 rotates the head lever 18 clockwise against the spring force of the stretch spring 44 when viewed from the top side thereof. This action causes the thermal head 17 to be pressed against the correctable ink ribbon 50, and through the recording sheet 58 against the platen 11, by the first strong pressing force of about 800 gf.

Then, at S8, a print processing is executed by the applied voltage, energizing time and printing speed stored in the respective memories 92, 94 and 95. At this time, the drive circuit 65 outputs the pulse signal PS to the heating elements 22, and the drive circuit 64 outputs the drive signal DS1 to the carriage drive motor 63. As a result, the thermal head 17 is moved in a printing direction while pressed against the platen 11 by the strong pressing force of about 800 gf, and at the same time, a relatively high voltage of 12 V is applied to the heating elements 22 for a relatively short time of 510 μsec, whereby the ink of the correctable ink ribbon 50 corresponding to the heating elements 22 is securely transferred to the recording sheet 58 in a state such that the ink is melted to some degree, as shown in FIG. 3(*a*). The transferred ink is strongly adhered to the recording sheet 58, due to the slow printing speed, and thus printing can be clearly effected on various kinds of recording sheet 58 including a sheet having a rough surface.

Then, at S9, it is determined whether or not CPU 70 has detected a head release instruction signal or not. If this signal is not detected, steps S8 and S9 are repeated. When the CPU 70 has detected the head release signal, based on the input of a line feed instruction and a sheet feed instruction or completion of the print processing, the determination at S9 is YES, and accordingly the CPU 70 outputs the control signal CS2 to the drive circuit 67 through the I/O port 69, based on the second pulse number data, and the drive circuit 67 outputs the drive signal DS2 to the pressure changing motor 66. As a result, at S10 the direction of the motor 66 is reversed and the motor 66 is driven to the initial position by a predetermined number of rotations, to rotate the head drive cam 33A to the non-printing position shown in FIG. 10 at S10 and the flow returns to S2. This operation returns the thermal head 17 to the release position shown in FIG. 9.

When the mode flag F is reset, the determination at S5 is NO, and thus at S13 various data stored in the print/correction mode table in ROM 71 is read out and written to the predetermined memories 92 to 95 in the RAM 90.

Next, at S13, the CPU 70 outputs the control signal CS2 to the drive circuit 67 through the I/O port 69, based on the second pulse number data stored in the pulse number data memory 93 and the drive circuit 67 applies the drive signal DS2 to the pressure changing motor 66 so that the motor 66 is driven for a predetermined number of rotations. As a result, the head drive cam 33 is rotated to the second pressing position shown in FIG. 7, and a relatively low voltage of 9 V is applied to the heating elements 22 for a relatively long time of 850 μsec while the thermal head 17 is pressed against the platen 11 by the second pressing force of about 400 gf, which is weaker than the first pressing force, and thus the ink of the correctable ink ribbon 50 is gradually heated and transferred to the recording sheet 58 in a semisolid state and the transferred ink is weakly adhered to the recording sheet 58, due to the slow printing speed, and thus printing is effected such that the transferred ink can be easily exfoliated by the correctable ink ribbon 50 [refer to FIGS. 3(*b*) and (*c*)].

Next, the flow returns to step S2 through step S9, and accordingly the thermal head 17 is returned to the release position shown in FIG. 9. Note that the head release instruction signal is based on the control program for controlling the printing mechanism PM and the display mechanism of the ROM 71 when the carriage is returned, the sheet is fed, or a memory mode is started.

As described above, when printing is carried out in the print only mode, wherein the printed character will not be not deleted, the ink of the correctable ink ribbon 50 is securely transferred to the recording sheet 58 while in a required molted state, and further, since the transferred ink is strongly adhered to the recording sheet 58, printing can be clearly effected to various kinds of recording sheet including a sheet having a rough surface.

In addition, when printing is carried out in the print/-correction mode, wherein the printed characters can be deleted, the ink of the correctable ink ribbon 50 is transferred to the recording sheet 58 in a semisolid state, and further, since the transferred ink is weakly adhered to the recording sheet 58, the ink is printed in a state such that it is easily exfoliated, whereby the deletion performance is improved when a character must be deleted.

Note that the values set to the pressing force, applied voltage, energizing time and the like stored in the print mode table and the print/correction mode table are only examples and can be changed according to the kind of the correctable ink ribbon 50 used.

Further, the correctable ink ribbon 50 can be used in the print-correction mode and a ink ribbon other than the correctable ink ribbon 50, such as a one time ink ribbon and the like can, be used in the print only mode.

Next, an electronic typewriter using a pressing force/exfoliation angle changing mechanism will be described, as a modification of the pressure changing mechanism.

In this modification, three printing modes effected by selectively switching a one time ink ribbon (hereinafter referred to as a one time ribbon) 49, a correctable ink ribbon (hereinafter referred to as a correctable ribbon) 50, and a multi-time ink ribbon (hereinafter referred to as a multi-time ribbon) 51 by operating the print mode setting switch 7 shown in FIG. 5.

As shown in FIG. 16, in this electronic typewriter the pressure changing mechanism 10A has been replaced by the pressing force/exfoliation angle changing mechanism 10B, as a modification thereof.

As shown in FIG. 18, a stretch spring 44B is stretched between the lug 43 of a head lever 18 and the lug 16 of a unit frame 15. The stretch spring 44B is preloaded with a predetermined tension, to stably hold the thermal head 17 at a release position (non-printing position) shown in FIG. 18, and is set to a spring force weaker than a preload set to a stretch spring 42B.

As shown in FIG. 17, the head drive cam 33B has the first operating cam surface 45B, the second operating cam surface 46B, and the third operating cam surface 47B successively formed thereon, and the cam distances thereof from the center of the pin 32 to the respective cam operating surfaces 45B, 46B, and 47B satisfy the following relationship.

$$C1 < C3 < C2$$

wherein,

C1: a cam distance of the first operating cam surface 45B

C2: a cam distance of the second operating cam surface 46B

C3: a cam distance of the third operating cam surface 47B

The first operating cam surface 45B is used to hold the thermal head 17 at the release position, and a position to which the head drive cam 33B is rotated when the roller 39 of the arm 37 is held in abutment against the first cam operating surface 45B, is the non-printing position (refer to FIGS. 18 and 19). The second operating cam surface 46B following the first operating cam surface 45B is used to press the thermal head 17 against the platen 11 with a strong pressing force of about 800 gf when printing is carried out using the one-time ribbon 49 or the correctable ribbon 50, and a position to which the head drive cam 33B is rotated when the roller 39 of the arm 37 is held in abutment against the second cam operating surface 46B is a printing position. The third operating cam surface 47B following the first operating cam surface 45B is used to press the thermal head 17 against the platen 11 with a relatively weak pressing force of about 300 gf when printing is carried out using the multi-time ribbon 51, and a deletion is carried out by using the correctable ribbon 50, and a position to which the head drive cam 33B is rotated when the roller 39 of the arm 37 is held in abutment against the third cam operating surface 47B, is a print/-correction position.

The blade drive cam 34B has an exfoliation angle changing cam surface 48B as shown by a two-dot-and-dash line in FIG. 17. This exfoliation changing cam surface 48B has the same phase as that of the third operating cam surface 47B of the head drive cam 3, and thus an exfoliation angle is changed at a position to which the blade drive cam 34 is rotated when the roller 53 of an arm 41 is held in abutment against the exfoliation angle changing cam surface 48B.

A recording sheet 58 is fed between the platen 11 and the thermal head 17 by a sheet feed roller driven by a sheet feed motor 61, and a one time ribbon cassette 74 (refer to FIG. 22) onto which the onetime ribbon 49 is wound, a correctable ribbon cassette 75 (refer to FIG. 26) onto which the correctable ribbon 50 capable of deleting a character is wound, or a multi-time ribbon cassette 76 (refer to FIG. 25) onto which the multi-time ribbon 51 is wound, are selectively and detachably mounted on a carriage 14. Each of these ribbons 49 to 51 wound onto the feed spools of the ribbon cassettes 74 to 76, respectively, is wound onto a winding spool through the space between the thermal head 17 and the recording sheet 58. Note that, as shown in FIG. 25, a cutout hole **76*a* is formed at the rear left edge of the multi-time ribbon cassette 76 to enable movement of a correction blade 19. A locking portion 76*b* is formed on the rear end wall of the cutout hole 76*a*, to prevent the movement of the correction blade 19 from a retracted position to an operating position at which the blade 19 is pressed against a platen 11**, while it is moved.

In this modification, two signal lines are connected to the print mode setting switch 7 provided on the keyboard 3. When the print mode setting switch 7 is switched to the one time ribbon mode, 2 bits of ribbon data signals each having an "H" level (switching signals) are output to the two signal lines; when the switch 7 is switched to the correctable ribbon mode, 2 bits of ribbon data signals having an "H" level and an "L" level, respectively, are output thereto; and when the switch 7 is switched to the multi-time ribbon mode, 2 bits of ribbon data signals each having an "L" level are output thereto.

The above printing condition control program stored in the ROM 71 in FIG. 8 includes a one-time ink ribbon table for setting the optimum printing conditions for the one-time ribbon 49, a correctable ink ribbon table for setting the optimum printing conditions for the correctable ribbon 50, a multi-time ink ribbon table for setting the optimum printing conditions for the multi-time ribbon 51, and a correctable ribbon delete condition table for setting the optimum deleting conditions for deleting a character by the correctable ribbon 50.

Table 2 shows the printing and deleting conditions in accordance with the kind of ribbons used.

In Table 2, A designates a pressing force of the thermal head 17 (gf), B designates an exfoliating angle (°) of the ribbon platen 11, C designates a printing speed (characters/sec), D designates a voltage (V) applied to the heating elements, E designates a voltage energizing time (μsec), and F designates an energy (mj/mm$^2$) applied to the heating elements 2.

TABLE 2

| | A | B | C | D | E | F |
|---|---|---|---|---|---|---|
| one-time ribbon (print) | 800 | 70 | 30 | 13 | 486 | 17 |
| correctable ribbon (print) | 800 | 70 | 15 | 13 | 571 | 20 |
| multi-time ribbon (print) | 300 | 30 | 15 | 13 | 571 | 20 |
| correctable ribbon (delete) | 300 | 0 | 10 | 13 | 486 | 17 |

Therefore, the one-time ink ribbon table stores, (1) printing position pulse number data for driving the motor 66 to rotate the head drive cam 33 from a non-printing position shown in FIG. 19 to a printing position shown in FIG. 21, to set a pressing force of the thermal head 17 to about 800 gf without moving the correction blade 19 to an operating position: (2) control frequency data for controlling the carriage drive motor 63 to effect a printing operation at a print speed of 30 characters/sec: (3) voltage application instruction data for producing an instruction to apply a voltage (pulse voltage) of 13 V from a drive circuit 65: (4) energizing time (pulse width) data for applying a voltage for 486 μsec, etc.

Further, the correctable ink ribbon table stores, (1) printing position pulse number data for driving the motor 66 to rotate the head drive cam 33 from a non-printing position to a printing position, to set a pressing force of the thermal head 17 to about 800 gf without moving the correction blade 19 to an operating position: (2) control frequency data for controlling the carriage drive motor 63 to effect a printing operation at a print speed of 15 characters/sec: (3) a voltage application instruction data for producing an instruction to apply a voltage of 13 V from the drive circuit 65: and (4) energizing time (pulse width) data for applying a voltage for 571 μsec, etc.

Furthermore, the multi-time ink ribbon table stores, (1) print/correction position pulse number data for driving the motor 66 to rotate the head drive cam 33 from a non-printing position to a print/correction position shown in FIG. 23, to set a pressing force of the thermal head 17 to about 300 gf without moving the correction blade 19 to an operating position: (2) control frequency data for controlling the carriage drive motor 63 to effect a printing operation at a print speed of 15 characters/sec: (3) a voltage application instruction data for producing an instruction to apply a voltage of 13 V from the drive circuit 65: and (4) energizing time data for applying a voltage for 571 μsec, etc.

Still, the correctable ribbon deleting condition table stores, (1) print/correction position pulse number data for driving the motor 66 to rotate the head drive cam 33 from a non-printing position to a print correction position, to move the correction blade 19 to an operating position and set a pressing force of the thermal head 17 to about 300 gf: (2) control frequency data for controlling the carriage drive motor 63 to effect a printing operation at a print speed of 10 characters/sec: (3) voltage application instruction data for producing an instruction to apply a voltage of 13 V from the drive circuit 65: and (4) energizing time data for applying a voltage for 486 μsec, etc.

A RAM 90 includes a print mode memory 91 to which print mode data is written. This print mode is included in a print mode data signal input from the print mode setting switch 7 according to the position at which the switch 7 is set. The RAM 90 also includes a control frequency data memory 92 for storing control frequency data, pulse number data, voltage application instruction data, and energizing time data, respectively, which data is read from the above tables, a pulse number data memory 93, a voltage application instruction data memory 94, an energizing time data memory 95, etc.

Next, a routine for controlling the printing conditions effected by the control unit C of the electronic typewriter 1 will be described with reference to a flowchart shown in FIG. 17. Note that this control also enables the deletion of a character by using the correctable ribbon 50.

As shown in the flowchart, when the typewriter 1 is switched on, first an initialization the flowchart, an initialization is effected at step S101 (hereinafter, simply referred to as S101; this also applies to all steps in the flowchart). Normally, at S101, the pressure changing motor 66 is initialized, the head drive cam 33 is rotated to the non-printing position as shown in FIG. 19, and the arm 37 is not allowed to rotate below the first operating cam surface 45, and accordingly, the stretch spring 44B has a spring force greater than that of the stretch spring 42B, whereby the thermal head 17 is held at a release position, and thus the correction blade 19 is held at a retracted position.

Next, a switch signal is input from a ink ribbon setting switch 7B provided on the keyboard 3, i.e., a ribbon data signal is read at S102, and ribbon data included in the ribbon data signal is written in the ribbon data memory 91 at S103.

Then, at S104, it is determined whether the CPU 70 has detected a print instruction signal at S104. When the CPU 70 has not detected this signal, at S105 it is determined whether the CPU 70 has detected a deletion instruction signal and if the CPU 70 has not detected this signal, steps S102 to S105 are repeated.

When a character key 5 or a print key is operated at the keyboard 3, and the CPU 70 detects the print instruction signal while the control program in the ROM 71 is executed, the determination at S104 is YES. When the ribbon data of the ribbon data memory 91 shows the one-time ribbon 49, the determination at S106 is YES and thus at S107 the respective data stored in the one-time ink ribbon table in the ROM 71 is read from the table and written to the predetermined memories 92 to 95 in the RAM 90.

Next, the CPU 70 outputs the control signal CS2 to the drive circuit 67 through the I/O port 69, based on the printing position pulse number data stored in the pulse number data memory 93, and the drive circuit 67 outputs the drive signal DS2 to the pressure changing motor 66, whereby at S108 the motor 66 is driven for a predetermined number of rotations. As a result, a drive shaft 25 is rotated in the direction of an arrow in FIG. 20, and accordingly the head drive cam 33 is rotated to a position shown in FIG. 21, and thus the stretch spring 42B rotates the head lever 18 clockwise against the spring force of the stretch spring 44B when viewed from the top side thereof. Accordingly, the thermal head 17 is pressed against the correctable ink ribbon 50 and through the recording sheet 58 to the platen 11 by, a strong pressing force of about 800 gf. At this time, since the blade cam lever 40 does not rotate as shown in FIG. 21, the correction blade 19 is held at the retracted position. Therefore, as shown in FIG. 22, the one-time ribbon 49 wound onto the winding spool passing through the thermal head 17 and the guide roller 74*a* is exfoliated from the recording sheet 58 at a exfoliating angle of $\theta_1$ of about 70° with respect to the platen 11, at a position lower than the thermal head 17.

Then, at S109, a print processing is executed by the applied voltage, energizing time and printing speed stored in the respective memories 92, 94 and 95. At this time, the drive circuit 65 outputs a pulse signal PS to the heating elements 22 and the drive circuit 64 outputs a drive signal DS1 to the carriage drive motor 63. As a result, the thermal head 17 is moved in a printing direction at a printing speed of 30 characters/sec while pressed against the platen 11 by the strong pressing force of about 800 gf with an exfoliating angle $\theta_1$ kept at about 70° and at the same time a voltage of 12 V is applied to the heating elements 22 for 486 μsec, whereby characters are printed by an optimum printing performance using the one-time ribbon 49.

Next, at S110, it is determined whether or not the CPU 70 has detected a head release instruction signal. If this signal has not been detected by the CPU 70, steps S109 and S10 are repeated. When the CPU 70 has detected the head release signal, based on the input of a line feed instruction and a sheet feed instruction or the completion of the print processing, the determination at S110 is YES, and accordingly the CPU 70 outputs the control signal CS2 to the drive circuit 67 through the I/O port 69, based on the printing position pulse number data, and the drive circuit 67 outputs the drive signal DS2 to the pressure changing motor 66. As a result, at S111, the direction of rotation of the motor 66 is reversed and the motor is driven to the initial position by a predetermined number of rotations, to rotate the head drive cam 33B to the non-printing position shown in FIG. 19 and the flow returns to S102. This operation returns the thermal head 17 to the release position shown in FIG. 18.

When the CPU 70 has detected a print instruction signal at S104, and the ribbon data in the ribbon data memory 91 is the correctable ribbon 50, the determination at S106 is NO and the determination at S112 is YES, and thus at S113 the respective data stored in the correctable ink ribbon table in the ROM 71 is read from the table and written to the predetermined memories 92 to 95 in the RAM 90. Next, at S108, the pressure changing motor 66 is rotated by a predetermined number of rotations, based on the printing position pulse number data stored in the pulse number data memory 93, and as a result, the pressing force is set to about 800 gf and the exfoliating angle $\theta_1$ is set to about 70°, as in the case of the one-time ribbon 49.

Next, a print processing is carried out based on the data of the respective memories 92, 94 and 95, through S109 and the thermal head 17 is moved in a printing direction at a printing speed of 15 characters/sec while pressed against the platen 11 by the strong pressing force of about 800 gf, with the exfoliating angle $\theta_1$ kept at about 70°, and at the same time, a voltage of 13 V is applied to the heating elements 22 for 571 μsec, whereby characters are printed by an the optimum printing performance using the correctable ribbon 50.

Further, when the CPU has detected the print instruction signal at S104, and the ribbon data in the ribbon data memory 91 is the multi-time ribbon 50, the determinations at S106 and S112 are NO, and thus at S114, the respective data stored in the multi-time ink ribbon table in the ROM 71 is read from the table and written to the predetermined memories 92 to 95 in the RAM 90.

Then, at S115, the pressure changing motor 66 is rotated by a predetermined number of rotation, based on the print/correction position pulse number data stored in the pulse number data memory 93 S115, and as a result, the drive shaft 25 is rotated in the direction shown by an arrow in FIG. 23 to rotate the head drive cam 33B to a print-correction position, rotate the blade drive cam 34B to an exfoliation angle changing position, and clockwise rotate a head lever 18 and a blade lever 20, when viewed from the top side thereof. This operation causes the thermal head 17 to be pressed against the platen 11 by a weak pressing force of about 300 gf, and the correction blade 19 to be moved to an operating position at which it is pressed against the platen 11. As shown in FIG. 25, however, the locking portion 76*b* of the multi-time ribbon cassette 76 prevents a full rotation of the correction blade 19, and thus an exfoliating angle $\theta_2$ below the thermal head 17 is set to about 30°.

Next, a print processing is carried out based on the data of the respective memories 92, 94 and 95 through S109 and the thermal head 17 is moved in a printing direction at a printing speed of 15 characters/sec while pressed against the platen 11 by the weak pressing force of about 300 gf, with the exfoliating angle $\theta_2$ kept at about 30°, and at the same time, a voltage of 13 V is applied to the heating elements 22 for 571 μsec, whereby characters are printed by an the optimum printing performance using the multi-time ribbon 51.

Then, the flow returns to S102, through S110 and S111, and accordingly, the thermal head 17 is returned to the release position shown by FIG. 18 and the correction blade 19 is returned to the retracted position thereof.

On the other hand, if a deletion instruction signal is input by the operation of a correction key 6, the determination at S105 is YES. Accordingly, at S116, and it is determined whether the ribbon data of the ribbon data memory 91 is the correctable ribbon 50. If the determination at S116 is NO, the flow returns to S102. If the determination is YES, at S117, the respective data stored in the correctable ribbon deletion condition table in the ROM 71 is read from the table and written to the predetermined memories 92 to 95 in the RAM 90. Then, at S118, the motor 66 is driven by a predetermined number of rotations, based on the print/correction position pulse number data stored in the pulse number data memory 93, and as a result, the drive shaft 25 is rotated in the direction shown by an arrow of FIG. 23 to rotate the head drive cam 33 to the print/correction position shown in FIG. 24, and clockwise rotate the head lever 18 and the blade lever 20, when viewed from top side thereof. This operation causes the thermal head 17 to be pressed against the platen 11 by the weak force of about 300 gf, and the correction blade 19 to be moved to an operating position at which it is pressed against the platen 11, as shown in FIG. 26. More specifically, an exfoliating angle 3 at this time is set to 0°. Next, at S119, a deletion processing is carried out based on the data of the respective memories 92, 94, and 95, and the thermal head 17 is moved in a printing direction at a printing speed of 10 characters/sec while pressed against the platen 11 by the weak pressing force of about 300 gf, with the exfoliating angle $\theta_3$ kept at 0°, and at the same time, a voltage of 13 V is applied to the heating elements 22 for 486 μsec, whereby characters are deleted by an optimum deleting performance using the correctable ribbon 50 [Refer to FIG. 3(*a*) to (*c*)].

Then, when the CPU 70 has detected a head release signal at S120, step S111 is executed and the flow returns to S102. This operation returns the thermal head 17 to the release position and the collection blade 19 to the retracted position. Note that a print instruction signal is produced based on a character print control program stored in the ROM 71, a deletion instruction signal is input through the correction key 6 of the keyboard 3, and a head release instruction signal is produced based on a program for controlling a print mechanism and a display mechanism stored in the ROM 71, when the carriage is returned, a sheet is fed, or a memory mode is started, etc.

As described above, according to the present invention, since printing conditions such as a pressing force, exfoliating angle of a ink ribbon, printing speed, applied voltage, and energizing time are prestored in accordance with the kind of ribbon used, such as the one-time ribbon 49, correctable ribbon 50, and multi-time ribbon 51, and the printing conditions are changed in accordance with the kind of ribbon used, printing can be carried out by an optimum printing performance with any kind of ribbon. As a result, the versatility of a thermal printer is greatly extended, and thus the production cost thereof can be reduced because one lot of the same kind of thermal printers cab be manufactured.

Note that, although the pressure changing mechanism of the embodiment and the pressing force/exfoliating angle changing mechanism of the modification are actuated by the cams driven by the motors, this invention can of course be applied to a mechanism wherein the thermal head 17 is pressed by a solenoid through levers and links.

Also note that the values preset in the above tables as the printing speeds, applied voltages, etc. are only examples and can be changed as necessary. Further, a sensor may be provided at the carriage 14 to detect the kind of ink ribbon used, and accordingly, the printing conditions can be selectively set in response to a signal output by the sensor and indicating the kind of the ribbon used.

What is claimed is:

1. A thermal printer comprising an ink ribbon, a platen, a thermal head confronting said platen, and a carriage reciprocally movable along said platen supporting said thermal head, ink on said ink ribbon being transferred, in accordance with an image to be printed, by means of said thermal head onto a recording medium loaded on said platen, said printer comprises:

memory means having stored therein predetermined printing condition data corresponding to a plurality of print modes, said plurality of print modes including a mode in which only printing can be executed and a mode in which printing and erasing can both be executed, said printing condition data being determined depending upon characteristics of a plurality of types of said ink ribbon;

select means for selecting one of said plurality of print modes; and setting means for setting printing conditions based on the data stored in said memory means in accordance with the print mode selected by said select means.

2. The thermal printing according to claim 1, wherein said plurality of types of ink ribbon are based on materials from which said ink ribbon is made, respectively.

3. The thermal printer according to claim 2, wherein said plurality of types of ink ribbons comprise a print ribbon only for printing, and a correctable ink ribbon for printing and correcting, which are made of different materials, respectively.

4. The thermal printer according to claim 1, wherein said setting means comprises a voltage supply means for supplying a predetermined voltage to said thermal head based on said printing condition data stored in said memory means in accordance with the print mode selected by said select means.

5. The thermal printer according to claim 1, wherein said setting means comprises a voltage supply means for supplying a voltage to said thermal head for a predetermined time based on said printing condition data stored in said memory means in accordance with the print mode selected by said select means.

6. The thermal printer according to claim 1, wherein said setting means causes said thermal head to press said ink ribbon against said platen at a predetermined pressure based on said printing condition data stored in said memory means in accordance with the print mode selected by said select means.

7. The thermal printer according to claim 1, wherein said ink ribbon and said platen are at an angle with respect to each other, and said setting means sets the angle between said ink ribbon and said platen at a predetermined angle based on said printing condition data stored in said memory means in accordance with the print mode selected by said select means.

8. The thermal printer according to claim 1, wherein said setting means has a carriage drive means for moving said carriage at a predetermined speed based on said printing condition data stored in said memory means in accordance with the print mode selected by said select means.

9. A thermal printer comprising an ink ribbon, a platen, a thermal head confronting said platen, and a carriage reciprocally movable along said platen supporting said thermal head, ink on said ink ribbon being transferred, in accordance with image to be printed, by means of said thermal head onto a recording medium loaded on said platen, carriage drive means for moving said carriage at a predetermined speed;

memory means having stored therein predetermined printing condition data corresponding to a plurality of print modes, said plurality of print modes including a mode in which only printing can be executed and a mode in which printing and erasing can both be executed, said printing condition data being determined depending upon characteristics of a plurality of types of said ink ribbon;

select means for selecting one of said plurality of print modes;

voltage supply means for supplying a predetermined voltage to said thermal head for a predetermined time based on said printing condition data stored in said memory means in accordance with the print mode selected by said select means; and thermal head drive means for pressing said thermal head against said platen based on said printing condition data stored in said memory means in accordance with the print mode selected by said select means;

a drive source for driving said thermal head drive means based on said printing condition data stored in said memory means in accordance with the print mode selected by said select means; and transmitting means for transmitting a power of said drive source, wherein said thermal head drive means, said drive source and said transmitting means are disposed on said carriage.

10. The thermal printer according to claim 9, wherein said plurality of types of ink ribbons are based on the materials of which said ink ribbons are respectively made.

11. The thermal printer according to claim 10, wherein said plurality of types of ink ribbons comprises a print ribbon and a correctable ink ribbon, which are made of different materials, respectively.

12. The thermal printer according to claim 9, wherein said thermal head driving means causes said thermal head to press said ink ribbon against said platen at predetermined pressure based on said printing condition data stored in said memory means in accordance with the print mode selected by said select means.

13. The thermal printer according to claim 12, which further comprises a holding means for holding said ink ribbon in such a manner that said ink ribbon and a surface of said recording medium are at a predetermined angle at a position where said ink ribbon is exfoliated from said recording medium.

14. The thermal printer according to claim 13, wherein said drive source comprises a step motor, and said transmitting means comprises a gear train, a first cam rotated by said gear train, and a first cam lever having one end engaged with said first cam and pivotally supported to be slidingly driven by rotation of said first cam.

15. The thermal printer according to claim 14, wherein said first cam has three regions for slidingly driving said first cam lever by the rotation thereof and said thermal head is positioned at three kinds of pressing positions including a non-printing position by sliding an other end of said first cam lever.

16. The thermal printer according to claim 14, wherein said holding means has a blade means, said drive power transmitting means comprises a second cam rotated by said gear train together with said first cam and a second cam lever having one end engaged with said second cam and pivotally supported to be slidingly driven by the rotation of said second cam, whereby an other end of said second cam lever enables said blade means to change the angle of said ink ribbon with respect to said platen.

17. The thermal printer according to claim 16, wherein said blade means performs in one of said modes where the ink transferred on said recording medium is adhered on said ink ribbon and exfoliated from said recording medium, and said second cam has an operating region by which said second cam lever is slid in a phase corresponding to one of three regions of said first cam, whereby the other end of said second cam lever enables said blade means to cause said ink ribbon to be held in abutment against said platen when the ink transferred onto said recording medium is to be exfoliated therefrom.

18. The thermal printer according to claim 9, said select means comprises a switch means for inputting one of said print modes.

* * * * *